US005094937A

United States Patent [19]

Morimoto

[11] Patent Number: 5,094,937

[45] Date of Patent: Mar. 10, 1992

[54] METHOD FOR PROCESSING SILVER HALIDE COLOR PHOTOGRAPHIC MATERIAL

[75] Inventor: Kiyoshi Morimoto, Minami-ashigara, Japan

[73] Assignee: Fuji Photo Film Co., Ltd., Kanagawa, Japan

[21] Appl. No.: 560,649

[22] Filed: Jul. 31, 1990

[30] Foreign Application Priority Data

| | | | |
|---|---|---|---|
| Jul. 31, 1989 | [JP] | Japan | 1-198676 |
| Aug. 31, 1989 | [JP] | Japan | 1-224928 |
| Jan. 24, 1990 | [JP] | Japan | 2-14233 |

[51] Int. Cl.[5] ..... G03C 5/24

[52] U.S. Cl. ..... 430/485; 430/467; 430/489; 430/490; 430/491

[58] Field of Search ..... 430/464, 467, 489, 485, 430/490, 491, 399

[56] References Cited

U.S. PATENT DOCUMENTS

| | | | |
|---|---|---|---|
| 4,232,112 | 11/1980 | Kuse | 430/393 |
| 4,565,776 | 1/1986 | Kim et al. | 430/467 |
| 4,797,349 | 1/1989 | Takahashi et al. | 430/372 |
| 4,801,516 | 1/1989 | Ishikawa et al. | 430/380 |
| 4,853,321 | 8/1989 | Momoki et al. | 430/467 |
| 4,892,804 | 1/1990 | Vincent et al. | 430/380 |
| 4,965,175 | 10/1990 | Fujimoto et al. | 430/375 |

FOREIGN PATENT DOCUMENTS

| | | | |
|---|---|---|---|
| 0080896 | 11/1982 | European Pat. Off. . | |
| 0087370 | 8/1983 | European Pat. Off. . | |
| 0269740 | 3/1987 | European Pat. Off. . | |
| 0125278 | 2/1989 | European Pat. Off. . | |
| 135464 | 8/1984 | Japan | 430/399 |
| 5341 | 1/1986 | Japan . | |
| 4234 | 6/1986 | Japan . | |
| 2139370 | 3/1983 | United Kingdom . | |

OTHER PUBLICATIONS

James, The Theory of the Photographic Process, 4th ed., pp. 417–419, 1977.

Patent Abstracts of Japan, vol. 12, No. 114, (P-688)(2961), Apr. 12, 1988, JP-A-62 242938.

*Primary Examiner*—Hoa Van Le

*Attorney, Agent, or Firm*—Sughrue, Mion, Zinn, Macpeak & Seas

[57] ABSTRACT

There is disclosed a method for processing a silver halide color photographic material with a color developer containing a hydroxylamine compound and at a small opened surface ratio of the color developer by using an automatic processor. According to the disclosure, a rapid development excellent in decreasing the fluctuation of photographic properties for a high-silver-chloride silver halide color photographic material can be carried out.

19 Claims, No Drawings

METHOD FOR PROCESSING SILVER HALIDE COLOR PHOTOGRAPHIC MATERIAL

FIELD OF THE INVENTION

The present invention relates to a method for processing silver halide color photographic materials, and more particularly to an excellent processing method for development that processes a high-silver-chloride silver halide color photographic material, which method is excellent in rapidness of development and small in fluctuation of photographic performance in continuous processing.

BACKGROUND OF THE INVENTION

For the purpose of increasing the speed of the color development step and/or decreasing the quantity of replenisher, methods are being studied for processing color photographic materials having silver chloride emulsions instead of the silver bromide emulsions or silver bromoiodide emulsions that are conventionally in wide use. If the quantity of the replenisher is decreased, or the developing solution is used for a longer period of time, or a large amount of the photographic material is processed continuously, the photographic performance is liable to change, and therefore stable photographic performance cannot be retained.

Although, for example, JP-A ("JP-A" means unexamined published Japanese patent application) No. 106655/1988 and International Publication No. WO 04534/1987 (PCT application) disclose methods that use hydroxylamines as a preservative for color developers and, in particular, for color developers for high-silver-chloride color photographic materials, use of these methods only is not adequate to stabilize color developers.

On the other hand, such an attempt is made that the structure of color-developing tanks is contrived somehow, or a floating lid is used, so as to improve the storage quality of color developers. For example, JP-A Nos. 131138/1988, 216050/1988, and 235940/1988 describe methods wherein the opened surface ratio of the color developer is made small. Although color developers can be made stable against air oxidation when the opened surface ratio of the solution is made smaller, use of this method only is not necessarily satisfactory in suppressing the fluctuation of sensitivity and gradation due to continuous processing.

Thus, improvement is desired with respect to the point that the sensitivity and gradation are liable to fluctuate along with the change of the amount of the processed photographic material as the processing is continued. Further, when the quantity of the replenisher of the developing solution is decreased, it has been found that the stabilization of photographic performance is difficult in high-silver-halide color photographic materials, because the concentration of chloride ions in the developing solution increases.

BRIEF SUMMARY OF THE INVENTION

Therefore, the object of the present invention is to provide a processing method for development that uses a silver halide color photographic material and that can attain stable photographic performance wherein the fluctuation of sensitivity and gradation due to continuous processing is suppressed.

Other and further objects, features and advantages of the invention will appear more evident from the following description.

DETAILED DESCRIPTION OF THE INVENTION

The above object has been attained by the method described below. That is, the present invention provides a method for processing a silver halide color photographic material with a color developer by using an automatic processor, characterized in that said color developer contains at least one of compounds represented by the following formula (I):

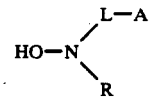

Formula (I)

wherein L represents an alkylene group which may be substituted, A represents a carboxyl group, a sulfo group, a phosphono group, a phosphinic acid residue, a hydroxyl group, an amino group which may be substituted by an alkyl group, an ammonio group which may be substituted by an alkyl group, a carbamoyl group which may be substituted by an alkyl group, a sulfamoyl group which may be substituted by an alkyl group, or an alkylsulfonyl group which may be substituted, and R represents a hydrogen atom or an alkyl group which may be substituted, and the opened surface ratio of the color developer in the tank of said automatic processor is 0.015 $cm^{-1}$ or below.

To suppress the fluctuation of photographic performance, although it is effective to make small the opened surface ratio of a color developer in an automatic processor, it has been found that when the opened surface ratio is 0.015 $cm^{-1}$ or below, the above effect for lessening fluctuation of photographic characteristics can be made remarkable only by using the constitution of the present invention. Although the reason is not made clear, it seems that, by using a compound of formula (I), for example, in the deterioration of the preservative of the color-developing agent, probably the oxidative degradation by oxygen in the air related to the opened surface ratio balances with the not-related-thereto thermal decomposition of the developing solution. Further the adverse influence on the photographic characteristics by the accumulation of components dissolved out from the photographic material along with the continuous processing is lessened by using the compound of formula (I).

Herein the term "opened surface ratio" means the value defined as follows:

$$\text{Opened surface ratio } (cm^{-1}) = \frac{\text{Contact surface area } (cm^2) \text{ of the color developer with the air}}{\text{Whole volume } (cm^3) \text{ of the color developer}}$$

"Contact surface area of the color developer with the air" means a surface area of the color developer that is not covered by anything such as floating lids or rollers.

In the present invention, it is particularly preferable that the opened surface ratio is 0 to 0.01 $cm^{-1}$, more preferably 0.001 to 0.01 $cm^{-1}$.

The opened surface ratio can be made small generally by applying a floating lid of a resin or the like for shutting off the air or by using a slit-type developing apparatus described, for example, in JP-A Nos. 131138/1988, 216050/1988, and 235940/1988.

Thus, when the opened surface ratio is lowered more than the usual level, it is utterly unexpected that the compound represented by Formula (I) exhibits a particularly conspicuous effect.

Next, compound of formula (I) is described in more detail.

In formula (I), L represents a straight-chain or branched-chain alkylene group which may be substituted having 1 to 10, preferably 1 to 5, carbon atoms. As specific preferable examples, methylene, ethylene, trimethylene, and propylene can be mentioned. The substituent includes a carboxyl group, a sulfo group, a phosphono group, a phosphinic acid residue, a hydroxyl group, and an ammonio group which may be substituted, and as preferable examples, a carboxyl group, a sulfo group, a phosphono group, and a hydroxyl group can be mentioned. A represents a carboxyl group, a sulfo group, a phosphono group, a phosphinic acid residue, a hydroxyl group, an amino group which may be substituted by an alkyl group, an ammonio group which may be substituted by an alkyl group (the substituent alkyl preferably having 1 to 5 carbon atoms), a carbamoyl group which may be substituted by an alkyl group (the substituent alkyl preferably having 1 to 5 carbon atoms), a sulfamoyl group which may be substituted by an alkyl group (the substituent alkyl preferably having 1 to 5 carbon atoms). Preferable examples of A include a carboxyl group, a sulfo group, a hydroxyl group, a phosphono group, and a carbamoyl group which may be substituted by an alkyl group. Preferable examples of -L-A include a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group, and as particularly preferable examples a carboxymethyl group, a carboxyethyl group, a sulfoethyl group, a sulfopropyl group, a phosphonomethyl group, and a phosphonoethyl group can be mentioned. R represents a hydrogen atom or an optionally substituted straight-chain or branched-chain alkyl group having 1 to 10, preferably 1 to 5, carbon atoms. The possible substituent includes a carboxyl group, a sulfo group, a phosphono group, a phosphinic acid residue, a hydroxyl group, an amino group which may be substituted by an alkyl group, an ammonio group which may be substituted by an alkyl group, a carbamoyl group which may be substituted by an alkyl group, a sulfamoyl group which may be substituted by an alkyl group, an alkylsulfonyl group which may be substituted, an acylamino group, an alkylsulfonylamino group, an arylsulfonylamino group, an alkoxycarbonyl group, an amino group which may be substituted by an alkyl group, an arylsulfonyl group, a nitro group, a cyano group, or a halogen group. Two or more substituents may be present in the groups. As preferable examples of R, a hydrogen atom, a methyl group, an ethyl group, a propyl group, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group can be mentioned, and as particularly preferable examples, a hydrogen atom, a carboxymethyl group, a carboxyethyl group, a sulfoethyl group, a sulfopropyl group, a phosphonomethyl group, and a phosphonoethyl group can be mentioned. L and R may bond together to form a ring.

Specific examples of the compounds of the present invention are given below, but the invention is not limited to them.

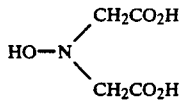
(1)

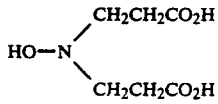
(2)

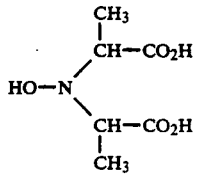
(3)

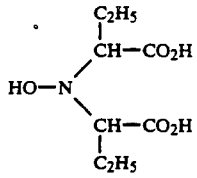
(4)

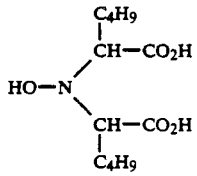
(5)

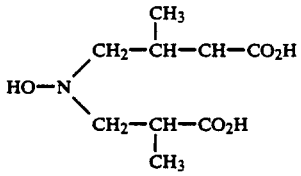
(6)

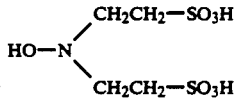
(7)

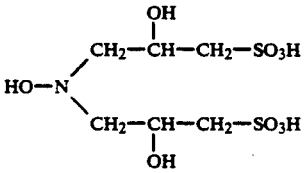
(8)

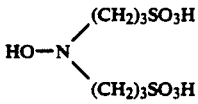
(9)

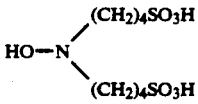
(10)

-continued
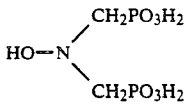
(11)
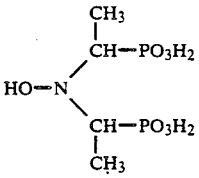
(12)
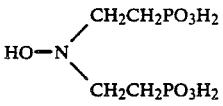
(13)
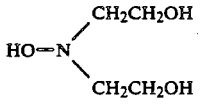
(14)
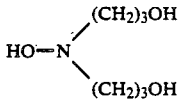
(15)
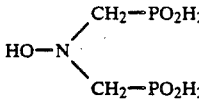
(16)
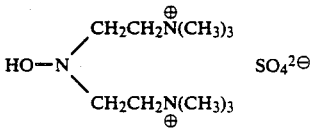
(17)
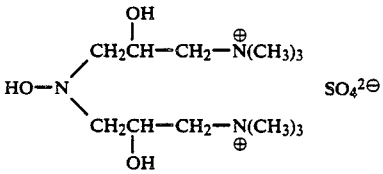
(18)
$HO-NH-CH_2CO_2H$ (19)
$HO-NH-CH_2CH_2CO_2H$ (20)
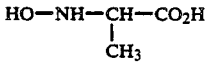
(21)
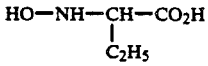
(22)
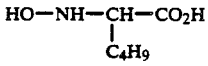
(23)
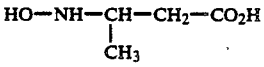
(24)
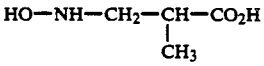
(25)
$HO-NH-CH_2CH_2SO_3H$ (26)
-continued
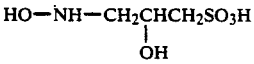
(27)
$HO-NH-(CH_2)_3SO_3H$ (28)
$HO-NH-(CH_2)_4SO_3H$ (29)
$HO-NH-CH_2PO_3H_2$ (30)
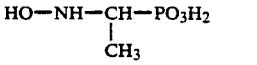
(31)
$HO-NH-CH_2CH_2PO_3H_2$ (32)
$HO-NH-CH_2CH_2OH$ (33)
$HO-NH-(CH_2)_3OH$ (34)
$HO-NH-CH_2-PO_2H_2$ (35)
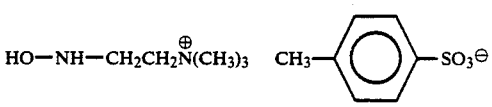
(36)
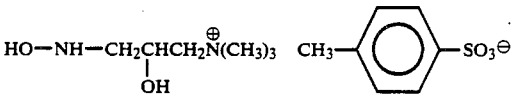
(37)
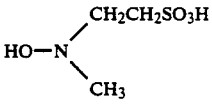
(38)
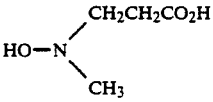
(39)
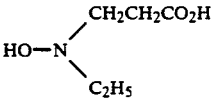
(40)
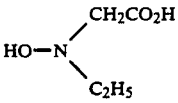
(41)
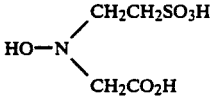
(42)
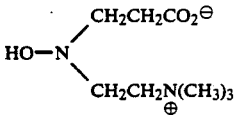
(43)
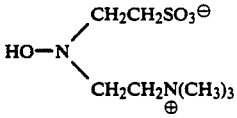
(44)
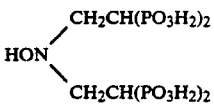
(45)
$HONHCH_2CH(PO_3H_2)_2$ (46)

-continued (47)

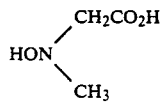

(48)

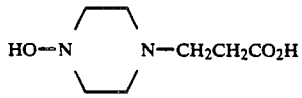

(49)

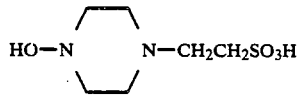

(50)

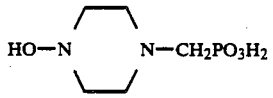

(51)

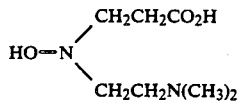

(52)

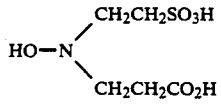

(53)

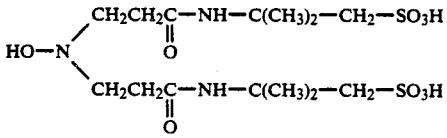

(54)

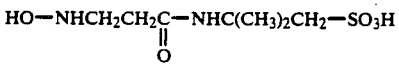

(55)

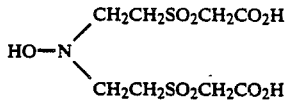

The amount of the compound of formula (I) to be added is preferably 0.1 to 50 g, more preferably 0.2 to 20 g, per 1 l of the color developer.

The compound represented by formula (I) can be synthesized by subjecting a commercially available hydroxylamine to an alkylation reaction (including a nucleophilic substitution reaction, an addition reaction, and a Mannich reaction). Although the compounds represented by formula (I) can be synthesized in accordance with the synthesis method disclosed, for example, in West German Patent Publication No. 1159634 or "Inorganica Chimica Acta," 93, (1984) 101-108, specific synthesis methods for them are described below.

SYNTHESIS EXAMPLES

SYNTHESIS OF EXEMPLIFIED COMPOUND (7)

11.5 g of sodium hydroxide and 96 g of sodium chloroethanesulfonate were added to 200 ml of an aqueous solution containing 20 g of hydroxylamine hydrochloride, and 40 ml of an aqueous solution containing 23 g of sodium hydroxide was added thereto gradually over 1 hour with the temperature being kept at 60° C. Further, while keeping the temperature at 60° C for 3 hours, the reaction liquid was condensed under reduced pressure, then 200 ml of concentrated hydrochloric acid was added, and the mixture was heated to 50° C. The insolubles were filtered off, and 500 ml of methanol was added to the filtrate to obtain crystals of the monosodium salt of the desired product (Exemplified Compound (7)) in an amount of 41 g (yield: 53%).

SYNTHESIS OF EXEMPLIFIED COMPOUND (11)

32.6 g of formalin was added to a hydrochloric acid solution containing 7.2 g of hydroxylamine hydrochloride and 18.0 g of phosphorous acid, and the mixture was heated under reflux for 2 hours. The resulting crystals were recrystallized using water and methanol, to obtain 9.2 g of Exemplified Compound (11) (yield: 42%).

In the present invention the above color developer can use, instead of the hydroxylamines and sulfite ions generally used as preservatives of developing agents, in addition to the compound represented by formula (I), the following organic preservatives.

Herein the term "organic preservative" means organic compounds in general that can reduce the degradation speed of the aromatic primary amine color-developing agents when added to the processing solution for the color photographic material. That is, organic preservatives are organic compounds having a function to prevent color-developing agents from being oxidized with air or the like. Of these, hydroxylamine derivatives (excluding hydroxylamine, the same being applied hereinafter), hydroxamic acids, phenols, α-hydroxyketones, α-aminoketones, saccharides, monoamines, diamines, polyamines, quaternary ammonium salts, nitroxy radicals, alcohols, oximes, diamide compounds, and condensed ring-type amines are particularly effective. They are disclosed, for example, in JP-A Nos. 4235/1988, 30845/1988, 21647/1988, 44655/1988, 53551/1988, 43140/1988, 56654/1988, 581346/1988, and 43138/1988, European Patent Publication No. 254280, JP-A Nos. 44657/1988 and 44656/1988, U.S. Pat. Nos. 3,615,503 and 2,494,903, JP-A No. 143020/1987, and JP-B ("JP-B" means examined Japanese patent publication) No. 30496/1973.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino]-aniline
D-6: 4-amino-3-methyl-N-ethyl-N-[β-(methane-sulfonamido)ethyl]-aniline
D-7: N-(2-amino-5-diethylaminophenylethyl)-methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) and 2-methyl-4-[N-ethyl-N-(β-hydroxyethyl)amino]-aniline (exemplified compound D-5) are particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 15 g, per liter of developer.

In the color developer according to the present invention, a compound represented by formula (A) shown below is more preferably used in view of attainment of better effect of the present invention.

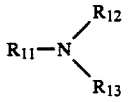

Formula (A)

wherein $R_{11}$ represents a hydroxyalkyl group having 2 to 6 of carbon atoms, $R_{12}$ and $R_{13}$ each represent a hydrogen atom, an alkyl group having 1 to 6 carbon atoms, a hydroxyalkyl group having 2 to 6 of carbon atoms, a benzyl group, or formula

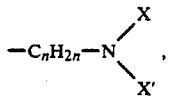

(wherein n is an integer of 1 to 6, and X and X' each represent a hydrogen atom, an alkyl group having 1 to 6 carbon atoms, a hydroxyalkyl group having 2 to 6 of carbon atoms). Preferable examples of compound represented by formula (A) are as follows:

(A-1): ethanolamine
(A-2): diethanolamine
(A-3): triethanolamine
(A-4): di-isopropanolamine
(A-5): 2-methylaminoethanol
(A-6): 2-ethylaminoethanol
(A-7): 2-dimethylaminoethanol
(A-8): 2-diethylaminoethanol
(A-9): 1-diethylamino-2-propanol
(A-10): 3-diethylamino-1-propanol
(A-11): 3-dimethylamino-1-propanol
(A-12): isopropylaminoethanol
(A-13): 3-amino-1-propanol
(A-14) 2-amino-2-methyl-1,3-propandiol
(A-15): ethylenediaminetetraisopropancl
(A-16): benzyldiethanolamine
(A-17): 2-amino-2-(hydroxymethyl)-1,3-propandiol
(A-18): 1,3-diaminopropanol
(A-19): 1,3-bis(2-hydroxyethylmethylamino)-propanol These compounds represented by the above formula (A) are, in view of the effect of the present invention, used preferably in an amount of 3 g to 100 g, and more preferably in an amount of 6 g to 50 g, per liter of the color developer.

In the color-developer according to the present invention, a compound represented by formulae (B-I) and (B-II) shown below is more preferably used in view of to attain better effect of the present invention.

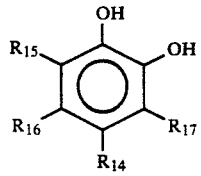

Formula (B-I)

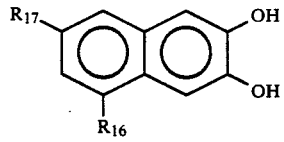

Formula (B-II)

wherein $R_{14}$, $R_{15}$, $R_{16}$, and $R_{17}$, each represent a hydrogen atom, a halogen atom, a sulfonic group, an alkyl group having 1 to 7 carbon atoms, $—OR_{18}$, $—COOR_{19}$,

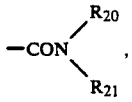

or phenyl group; and $R_{18}$, $R_{19}$, $R_{20}$, and $R_{21}$ each represent a hydrogen atom, an alkyl group having 1 to 18 carbon atoms, provided that when $R_{15}$ represents —OH or a hydrogen atom, $R_{14}$ represents a halogen atom, sulfonic group, an alkyl group having 1 to 7 carbon atoms, $—OR_{18}$, $—COOR_{19}$,

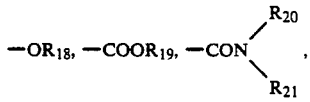

or a phenyl group.

Alkyl group represented by the above-described $R_{14}$, $R_{15}$, $R_{16}$, and $R_{17}$ include those having a substituent, and examples thereof that can be mentioned include, for example, methyl group, ethyl group, iso-propyl group, n-propyl group, t-butyl group, n-butyl group, hydroxymethyl group, hydroxyethyl group, methylcarbonic acid group, and benzyl group. Alkyl group represented by $R_{18}$, $R_{19}$, $R_{20}$, and $R_{21}$, has the same meaning as the above and further octyl group can be included.

As phenyl group represented by $R_{14}$, $R_{15}$, $R_{16}$, and $R_{17}$ phenyl group, 2-hydroxyphenyl group, and 4-amino-phenyl group can be mentioned.

Representative examples of the chelating agent of the preset invention are shown below, but the invention is not limited to them.

(B-I-1) 4-isopropyl-1,2-dihydroxybenzene
(B-I-2): 1,2-dihydroxybenzene-3,5-disulfonic acid
(B-I-3): 1,2,3-trihydroxybenzene-5-carbonic acid
(B-I-4): 1,2,3-trihydroxybenzene-5-carboxymethyl ester
(B-I-5): 1,2,3-trihydroxybenzene-5-carboxy-n-butyl ester
(B-I-6): 5-t-butyl-1,2,3-trihydroxybenzene
(B-I-7): 1,2-dihydroxybenzene-3,4,6-trisulfonic acid
(B-II-1): 2,3-dihydroxynaphthalene-6-sulfonic acid
(B-II-2): 2,3,8-trihydroxynaphthalene-6-sulfonic acid
(B-II-3): 2,3-dihydroxynaphthalene-6-carbonic acid
(B-II-4): 2,3-dihydroxy-8-isopropyl-naphthalene
(B-II-5): 2,3-dihydroxy-8-chloro-naphthalene-6-sulfonic acid Of the above-mentioned compounds, one that can be used preferably in particular in the present invention is 1,2-dihydroxybenzene-3,5-disulfonic acid, which may be used as the form of alkaline salt such as sodium salt and potassium salt (exemplified compound (B-I-2)).

In the present invention, compound represented by the above formulae (B-I) or (B-II) may be used in the range of 5 mg to 15 g, preferably 15 mg to 10 g, more preferably 25 mg to 7 g, per liter of color developer.

Preferably the pH of the color developer of the present invention is in the rang of 9 to 12, more preferably 9 to 11.0, and other known compounds that are components of a conventional developing solution can be contained.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below, but the present invention is not limited to them: nitrilotriacetic acid, diethyleneditriaminepentaacetic acid, ethylenediaminetetraacetic acid, triethylenetetraminehexaacetic acid, nitrilo-N,N,N-tris(methylenephosphonic acid), ethylenediamine-N,N,N',N'-tetrakis(methylenesulfonic acid), 1,3-diamino-2-propanoltetraacetic acid, transcyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-ortho-hydroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

Of these chelating agents, ethylendiaminetetraacetic acid, diethyleneditriaminepentaacetic acid, triethylenetetraminehexaacetic acid, 1-3-diamino-2-propanoltetraacetic acid, ethylenediamine-N,N,N',N'-tetrakis(methylenephosphonic acid), and hydroxyiminodiacetic acid are preferably used.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; p-aminophenols disclosed, for example, in U.S. Pat. Nos. 2,610,122 and 4,119,462; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, mesoionic type compounds, ionic type compounds, and imidazoles.

It is preferable that the color developer of the present invention is substantially free from benzyl alcohol. Herein the term "substantially free from" means that the amount of benzyl alcohol is 2.0 ml or below per liter of the developer, or preferably benzyl alcohol is not contained in the developer at all, because of being the fluctuation of photographic characteristics little.

For the purpose of preventing fogging or the like, it is required that the color developer contains chloride ions and bromide ions. In the present invention, preferably chloride ions are contained in an amount of $1.0\times10^{-2}$ to $1.5\times10^{-1}$ mol/l, more preferably $4.0\times10^{-2}$ to $1.0\times10^{-1}$ mol/l. If the concentration of ions exceeds $1.5\times10^{-1}$ mol/l, development is made disadvantageously slow. On the other hand, if the concentration of chloride ions is less than $1.0\times10^{-2}$ mol/l, fogging is not prevented, and further, the fluctuation of photographic properties (in particular minimum density) involved in continuous processing becomes great, not leading to attainment of the objects of the present invention.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, stain is not prevented, and the fluctuation of photographic properties, not leading to the attainment of the objects of the present invention.

As described above, when the opened surface ratio of the developer becomes 0.015 $cm^{-1}$ or below and the compound of the present invention is used, the fluctuation of photographic properties is improved remarkably. Further when the processing is carried out by using a color developer containing $4.0\times10^{-2}$ to $1.0\times10^{-1}$ mol/l of chloride ions and $1.0\times10^{-4}$ to $3.0\times10^{-4}$ mol/l of bromide ions, it has been found that the effect of improving the fluctuation of photographic properties is particularly good. This effect was unexpected, thus this method for processing is superior to suppress the fluctuation of photographic properties (in particular, the change of sensitivity).

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent as the form of its counter ion that will be added to the developer. As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As the brightening agent, 4,4'-diamino-2,2'-disulfostilbene compounds are preferable, which will be added in an amount of 0 to 10 g/l, preferably 0.1 to 6 g/l.

If required, various surface-active agents, such as alkylsulfonic acids, arylphosphonic acids, aliphatic carboxylic acids, and aromatic carboxylic acids may be added.

The processing time with the present color developer is, for example, 10 to 120 sec., preferably 20 to 60 sec. at a processing temperature of 33° to 45° C., more preferably 10 to 40 sec. at a processing temperature of 33° to 60° C., and most preferably 20 to 35 sec. at a processing temperature of 36° to 50° C., and under such conditions the effect of the present invention is particularly remarkable.

The amount of the replenisher of the color developer during continuous processing is 20 to 220 ml, preferably 25 to 160 ml, and particularly preferably 30 to 110 ml, per 1 $m^2$ of the photographic material, which is preferable because the effect of the present invention can be exhibited efficiently.

In the present process, it is one of preferable modes that the color development is carried out by slit processing. Herein by "slit processing" is meant that the photographic material is subjected to development and the like in a processing tank that has therein a processing path in the shape of a slit through which the photographic material is passed, in which processing path, when the processing path is cut perpendicularly to the direction of the advance of the photographic material, the cross section is in a so-called slit shape that is thinner relative to the lateral width (the direction of the width of the photographic material). The cross section of the slit may be rectangular or elliptic.

In the present invention desilvering is effected after color development. The desilvering step generally consists of a bleaching step and a fixing step, and particularly preferably the bleaching step and the fixing step are carried out simultaneously.

Further, the bleaching solution or the bleach-fixing solution used in the present invention can contain rehalogenation agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contain, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 8, and particularly preferably 4 to 7. If the pH is lower than this range, the desilvering is improved, but the deterioration of the solution and the leucolization of cyan dye are accelerated. In reverse, if the pH is higher than this range, the desilvering is retarded and stain is liable to occur.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, sulfinic acid, sulfinic acid, or carbonyl compounds, may be added.

If required, for example, buffers, brightening agents, chelating agents, and mildew-proofing agents may be added.

The processing time by the bleach-fixing solution of the present invention is in the range of 10 to 120 sec., preferably 20 to 60 sec., and the replenishing amount of the bleach-fixing solution is in the rage of 30 to 250 ml, preferably 40 to 150 ml, per square meter of photographic material. While it is generally liable to increase stain and occur an insufficient desilvering accompanying with the decrease of replenishing amount, the decrease of replenishing amount without these problems can be made according to the present invention.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers*, Vol. 64, pp. 248 to 253 (May 1955).

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 2 min, preferably 25° to 40° C. and 30 sec. to 1 min.

According to the present invention good photographic properties without the increasing of stain can be obtained even if processing by such short-time washing.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The time of processing process of the present invention is defined as the period from when the photographic material contacts the color developer to when it comes out of the last bath (generally a washing bath or stabilizing bath), and the effect of the present invention can be remarkably exhibited with a rapid processing time of 3 min 30 sec. or below, preferably 3 min or below.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive cqlor process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

In the present invention, the coating amount of silver halide is 1.5 g/m$^2$ or less, preferably 0.8 g/m$^2$ or less and 0.3 g/m$^2$ or more, in terms of silver. A coating amount of 0.8 g/m$^2$ or less is very preferable in view of rapidness, processing-stability, and storage-stability of image after processing (in particular, restraint of yellow stain). Further, the coating silver amount is preferably 0.3 g/m$^2$ or over, in view of image-density. From these points of view the coating amount of silver halide in terms of silver is more preferably 0.3 to 0.75 g/m$^2$, particularly preferably 0.4 to 0.7 g/m$^2$.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/silver chloride can be selected arbitrarily. That is, the ratio is selected from the broad range in accordance with the purpose, but the ratio of silver chloride in a silver chlorobromide is preferably 2% or over.

Further in the photographic material suitable for a rapid processing a emulsion of high silver chloride content, so-called a high-silver-chloride emulsion may be used preferably. The content of silver chloride of the high-silver-chloride emulsion is preferably 90 mol % or over, more preferably 95 mol % or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 $\mu$m.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose cf obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, *in Chimie et Phisicue Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium:, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in "Heterocyclic compounds - Cyanine dyes and related compounds" (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

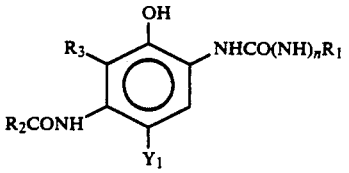

Formula (C-I)

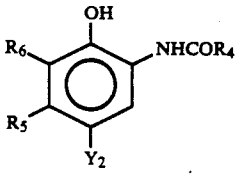

Formula (C-II)

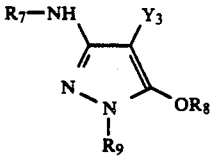

Formula (M-I)

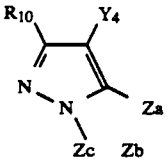

Formula (M-II)

-continued

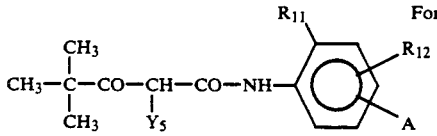

Formula (Y)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $—NHCOR_{13}$, $—NHSO_2—R_3$, $—SO_2NHR_{13}$, $—COOR_{13}$, or $$—SO_2\underset{\underset{R_{14}}{|}}{N}—R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C-1)

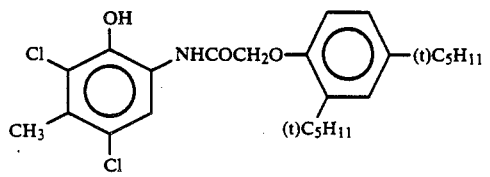

(C-2)

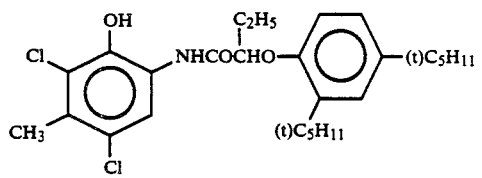

(C-3)

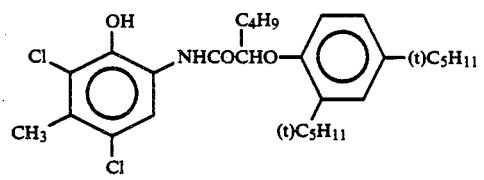

(C-4)

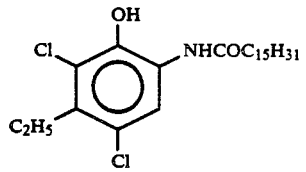

(C-5)

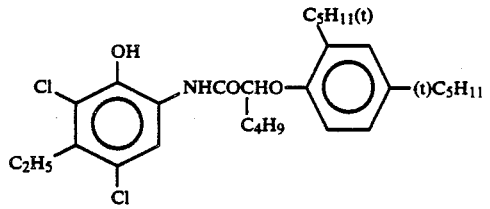

-continued
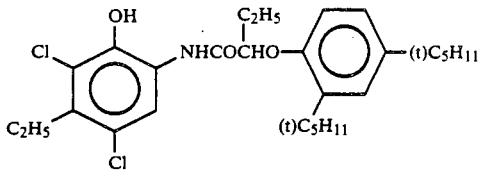
(C-6)
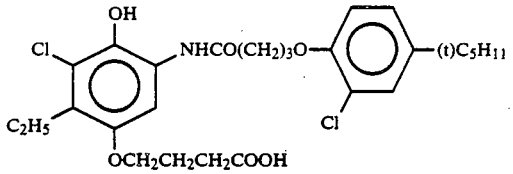
(C-7)
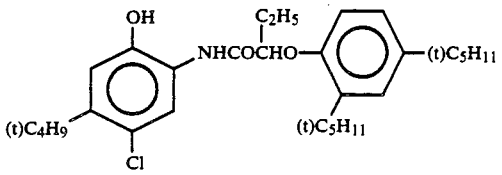
(C-8)
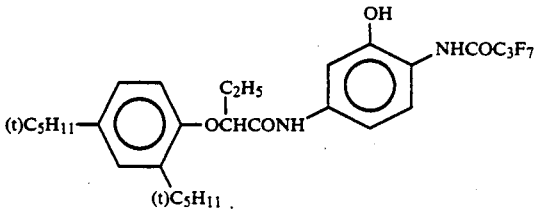
(C-9)
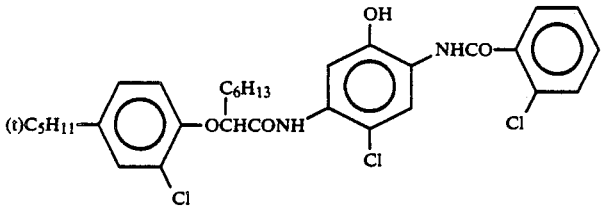
(C-10)
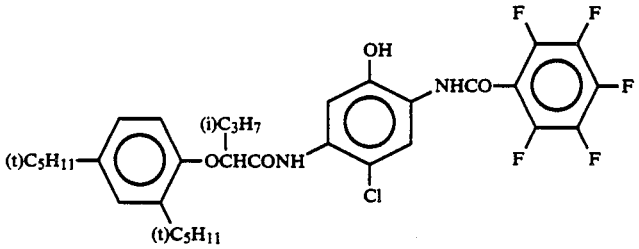
(C-11)
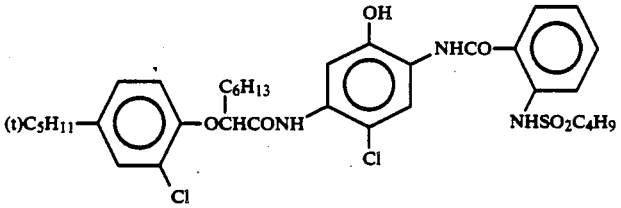
(C-12)

-continued
(C-13)
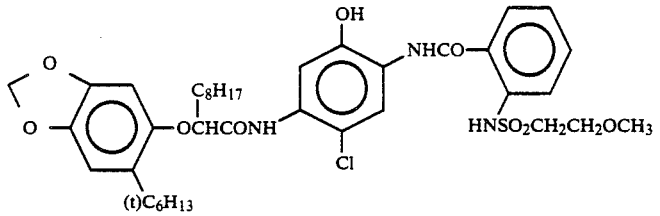
(C-14)
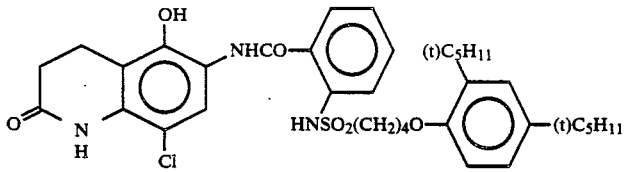
(C-15)
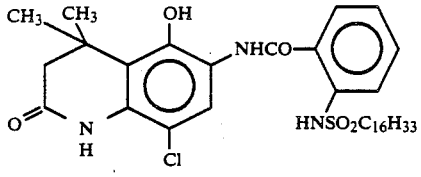
(C-16)
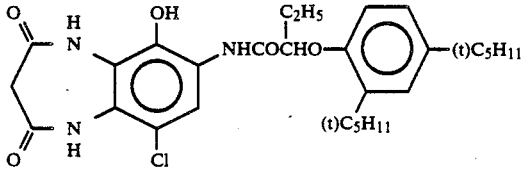
(C-17)
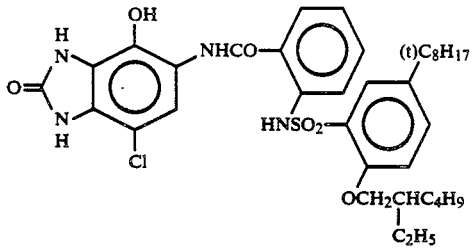
(C-18)
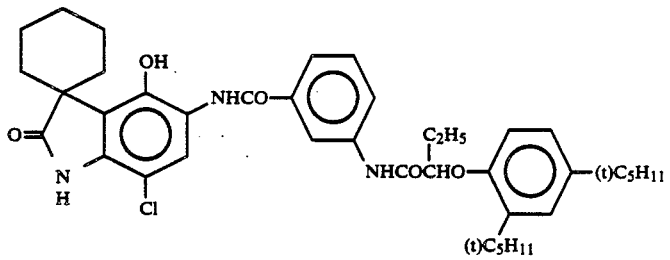
(C-19)
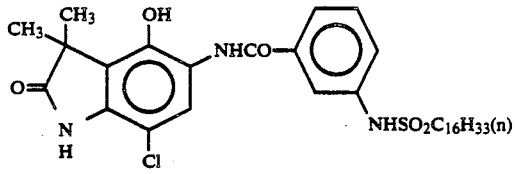

-continued
(C-20)
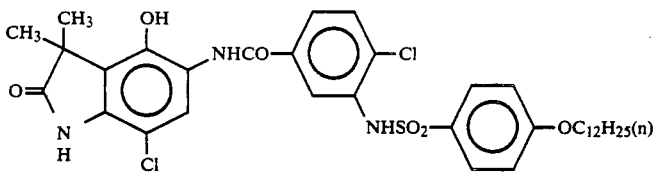
(C-21)
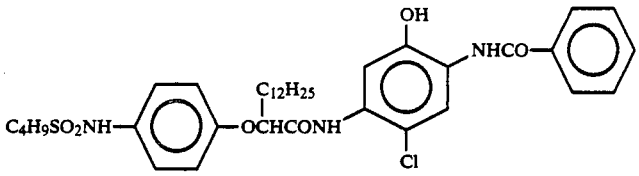
(C-22)
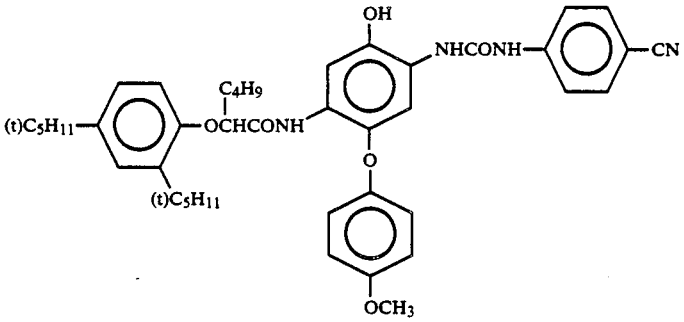
(M-1)
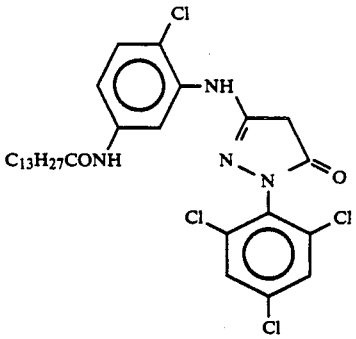
(M-2)
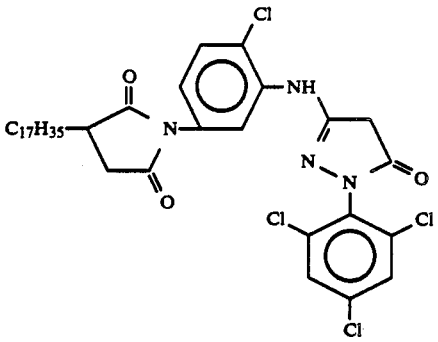

-continued
(M-3)
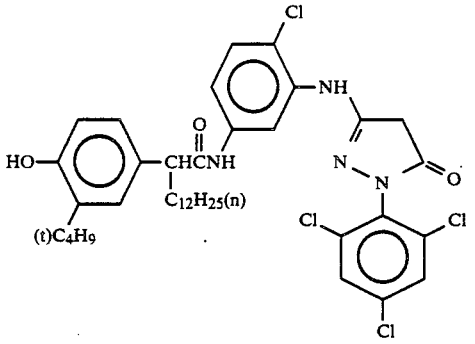
(M-4)
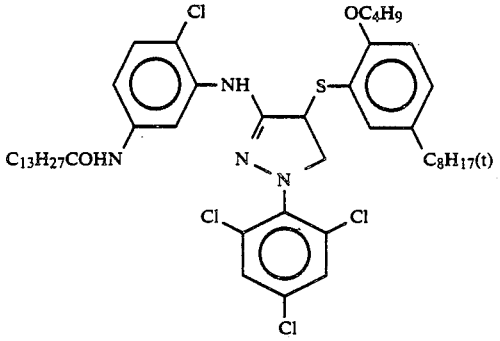
(M-5)
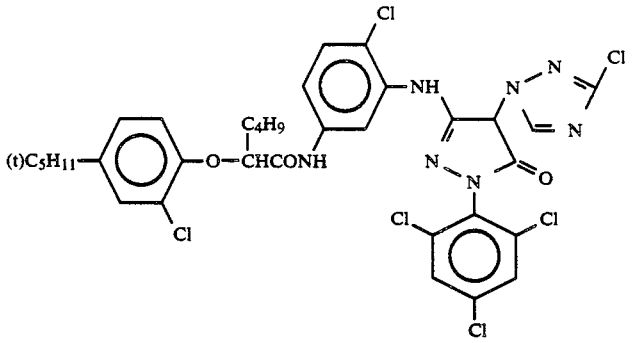
(M-6)
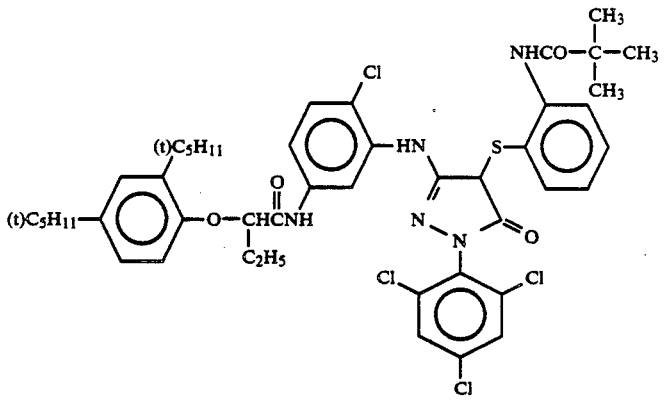

-continued
(M-7)
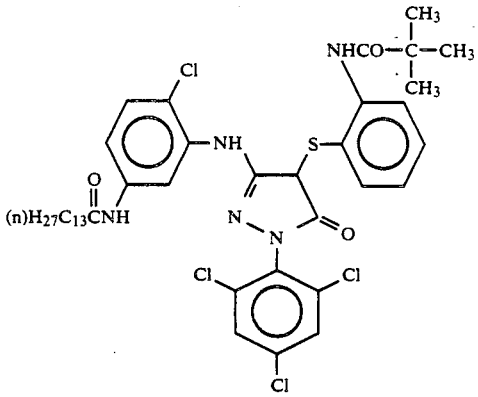
(M-8)
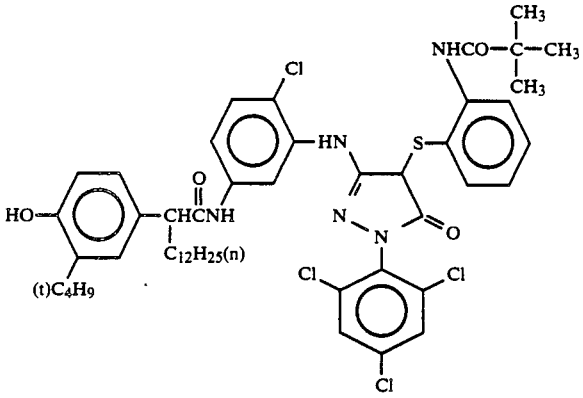

| Compound | $R_{10}$ | $R_{15}$ | $Y_4$ |
|---|---|---|---|
| | | 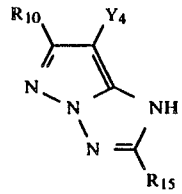 | |
| M-9 | $CH_3$— | 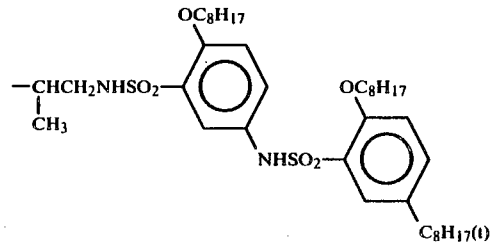 | Cl |
| M-10 | The same as the above | 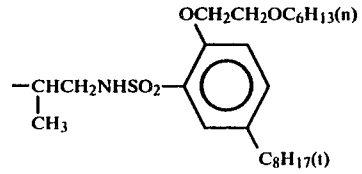 | The same as the above |
| M-11 | $(CH_3)_3C$— | 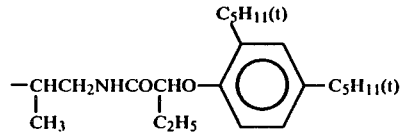 | 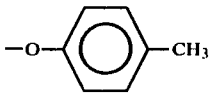 |
| M-12 | 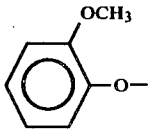 | 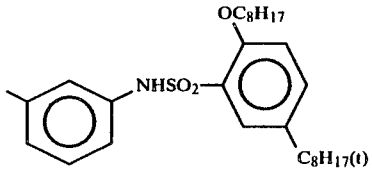 | 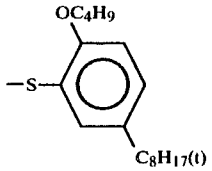 |

-continued
| Compound | $R_{10}$ | $R_{15}$ | $Y_4$ |
|---|---|---|---|
| M-13 | $CH_3$— | 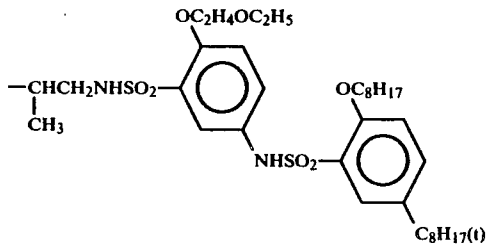 | Cl |
| M-14 | The same as the above | 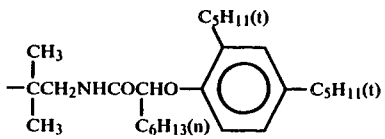 | The same as the above |
| M-15 | The same as the above | 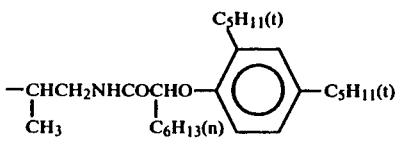 | The same as the above |
| M-16 | The same as the above | 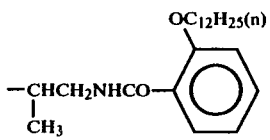 | The same as the above |
| M-17 | The same as the above | 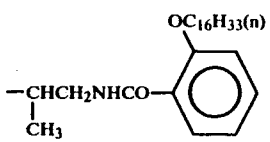 | The same as the above |

-continued
| Compound | $R_{10}$ | $R_{15}$ | $Y_4$ |
|---|---|---|---|
| M-18 | 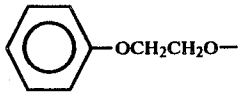 | 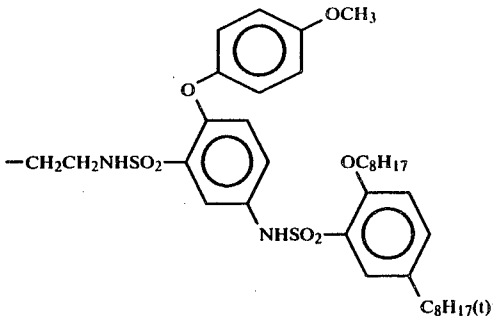 | 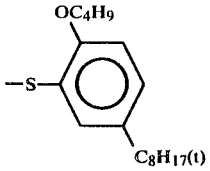 |
| M-19 | $CH_3CH_2O-$ | The same as the above | The same as the above |
| M-20 | 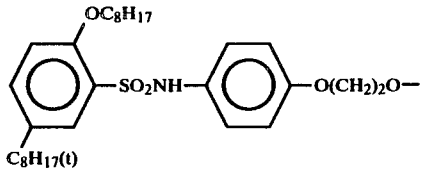 | 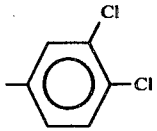 | 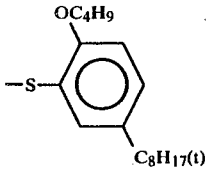 |
| M-21 | 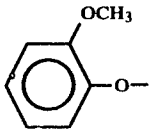 | 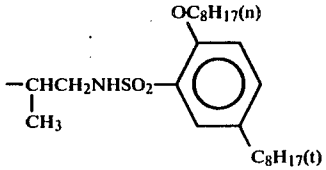 | Cl |
| | 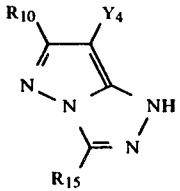 | | |
| M-22 | $CH_3-$ | 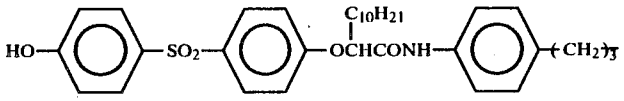 | Cl |

-continued

| Compound | $R_{10}$ | $R_{15}$ | $Y_4$ |
|---|---|---|---|
| M-23 | The same as the above | $(n)C_6H_{13}$ <br> $CHCH_2SO_2\text{-}(CH_2)_{\overline{2}}$ <br> $(n)C_8H_{17}$ | The same as the above |
| M-24 | $CH_3$ <br> $CH\text{—}$ <br> $CH_3$ | $OC_4H_9$ <br> $SO_2\text{-}(CH_2)_{\overline{3}}$ <br> $C_8H_{17}(t)$ | The same as the above |
| M-25 | $\text{-}(CH\text{—}CH_2)_{\overline{50}}\text{-}(CH_2\text{—}C)_{\overline{50}}\text{-}$ <br> $COOCH_2CH_2OCH_3$ $CH_3$ $CONH\text{—}$ | $CH_3\text{—}CH\text{—}$ <br> $CH_2NHSO_2CH_3$ | The same as the above |
| M-26 | $O\text{—}$ | $OC_8H_{17}$ <br> $\text{-}(CH_2)_2NHSO_2\text{—}$ <br> $C_8H_{17}(t)$ | The same as the above |
| M-27 | $CH_3\text{—}$ | $CH_3$ <br> $CH_3$ <br> $CH_3$ $NHCOCHO\text{—}$ <br> $(n)C_{10}H_{21}$ <br> $SO_2$ <br> $OCH_2$ | Cl |
| M-28 | $(CH_3)_3C\text{—}$ | $CH_3$ <br> $CH_3$ <br> $CH_3$ $NHCOCHO\text{—}$ <br> $C_4H_9(n)$ <br> $C_5H_{11}(t)$ <br> $C_5H_{11}(t)$ | The same as the above |

-continued
| Compound | $R_{10}$ | $R_{15}$ | $Y_4$ |
|---|---|---|---|
| M-29 | 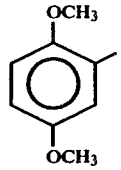 | 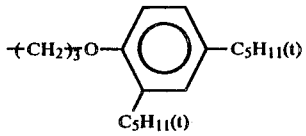 | The same as the above |
| M-30 | $CH_3$— | $(n)C_{18}H_{37}$<br>\|<br>—CH—$NCOCH_2CH_2COOH$<br>\|<br>$C_2H_5$ | The same as the above |

(Y-1)
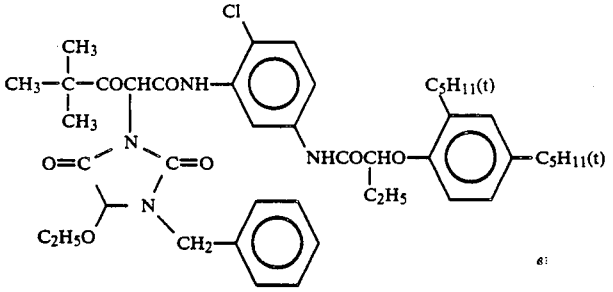
(Y-2)
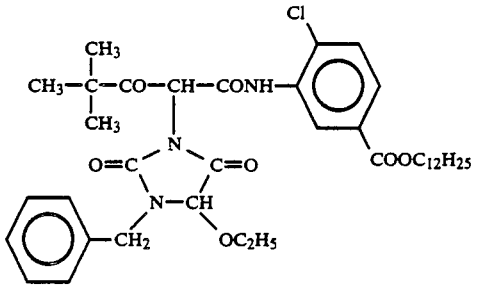
(Y-3)
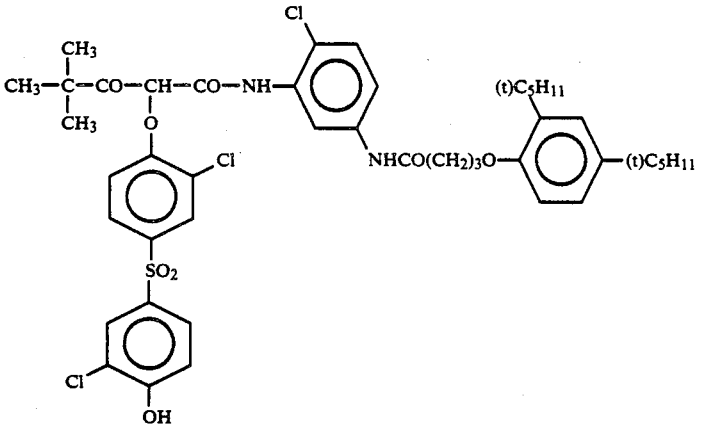
(Y-4)
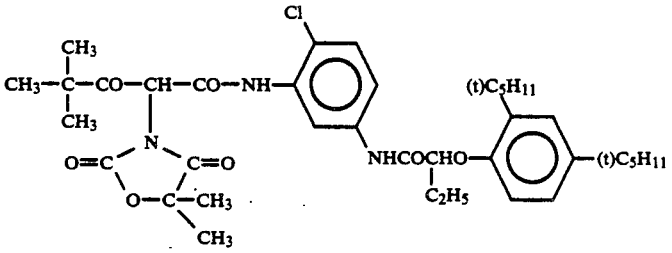
(Y-5)
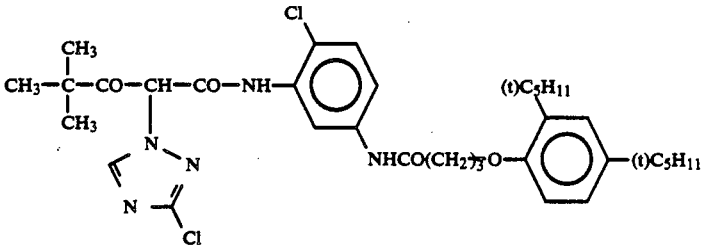

-continued (Y-6)

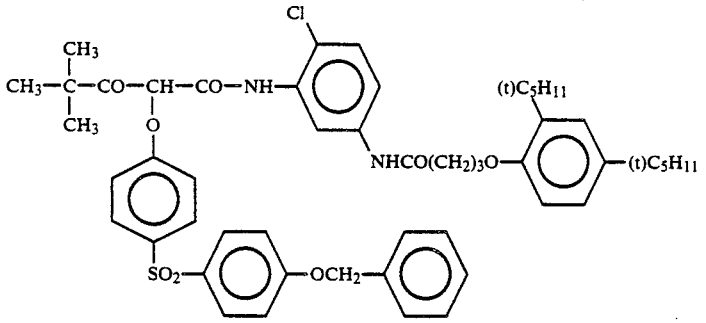

(Y-7)

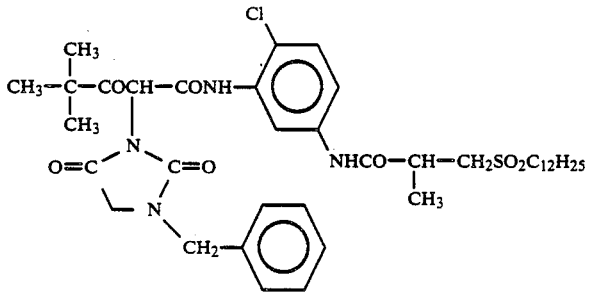

(Y-8)

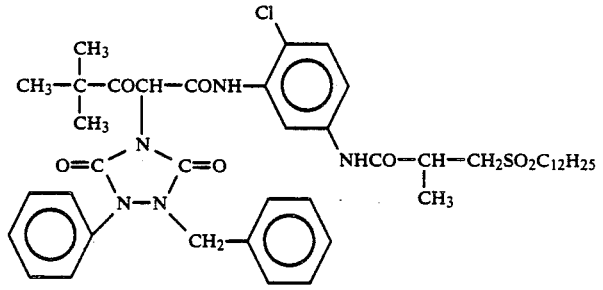

(Y-9)

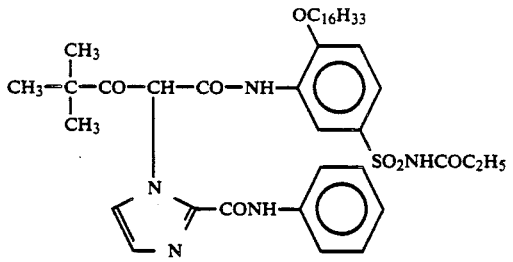

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

Formula (A')

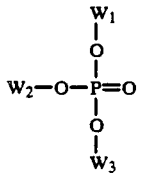

-continued $W_1—COO—W_2$ Formula (B')

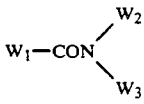

Formula (C')

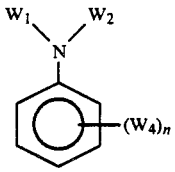

Formula (D')

$W_1—O—W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or S-$W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol.sec to $1\times10^{-5}$ l/mol.sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R'_1-(A_1)_n-X \qquad \text{Formula (FI)}$$

$$R'_2-\underset{\underset{B_1}{|}}{C}=Y \qquad \text{Formula (FII)}$$

wherein $R'_1$ and $R'_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R'_1$ and X, or Y and $R'_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R'_3 - Z \qquad \text{Formula (GI)}$$

wherein $R'_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio s/$\overline{R}$, wherein s stands for the standard deviation of Ri, and $\overline{R}$ stands for the average value of Ri. Preferably, the number (n) of the unit areas to be subjected is 6 or over. Therefore, the deviation coefficient s/$\overline{R}$ can be obtained by $$\sqrt{\frac{\sum_{i=1}^{n}(R_i - R)^2}{n-1}} \Big/ \frac{\sum_{i=1}^{n} R_i}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

As photographic materials for use in the method of the present invention, for example, color paper, color reversal paper, color negative film for photography, color reversal film, negative or positive film for cinema, and direct positive color photographic material can be mentioned.

As the photographic material for use in the present invention the following may be used preferably. That is, the photographic material comprises the silver halide photographic emulsion layer of a monodisperse silver halide emulsion containing silver chloride of 95 mol % or over and the reflection base having a water resistant resin layer that contains titanium oxide of 14 wt. % or over on which the photographic layer being coated, and has the photographic layer of which reflection density is 0.7 or over at 680 nm providing that the ratio of density at 550 nm divided by the density at 680 nm is 1.0 or below.

Next, the present invention will be described in detail in accordance with examples, but the invention is not limited to these Examples.

EXAMPLE 1

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

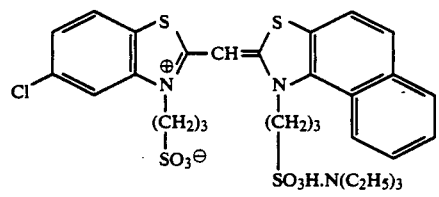

and

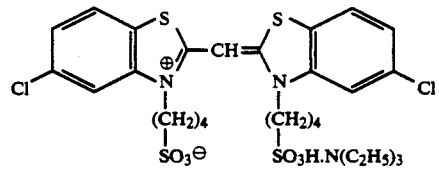

(each $2.0\times10^{-4}$ mol to the large size emulsion and $2.5\times10^{-4}$ mol to the small size emulsion, per mol of silver halide.)

Green-sensitive emulsion layer:

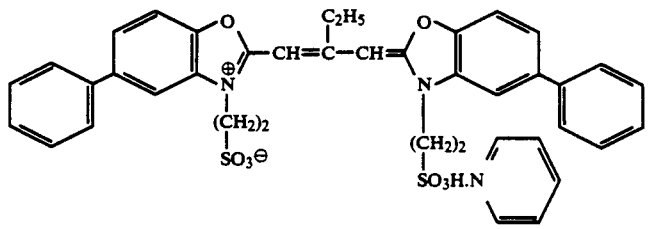

($4.0\times10^{-4}$ mol to the large size emulsion and $5.6\times10^{-4}$ mol to the small size emulsion, per mol of silver halide) and

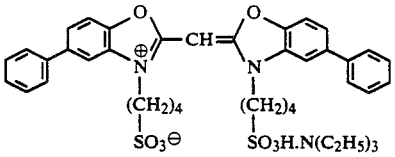

($7.0\times10^{-5}$ mol to the large size emulsion and $1.0\times10^{-5}$ mol to the small size emulsion, per mol of silver halide)

Red-sensitive emulsion layer:

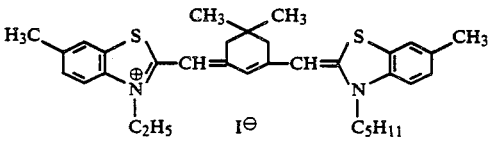

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

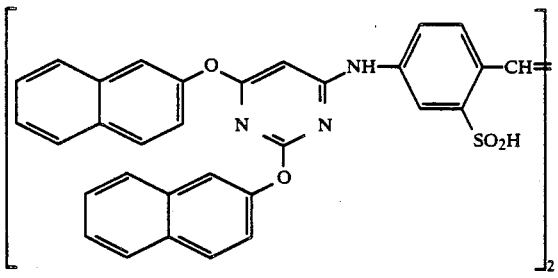

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

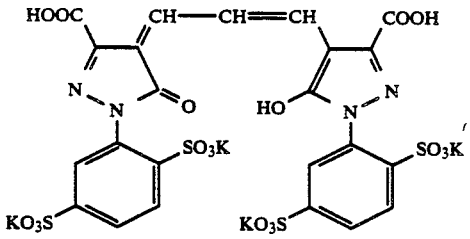

and

-continued

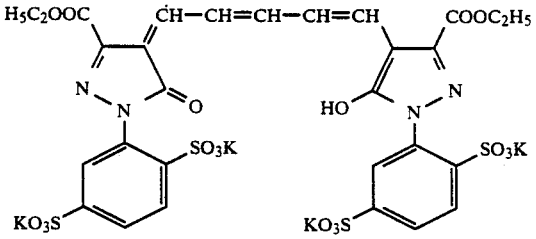

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |

-continued

| | |
|---|---|
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

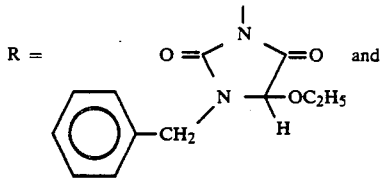

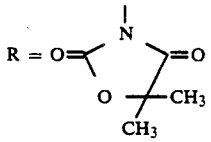

of the following formula

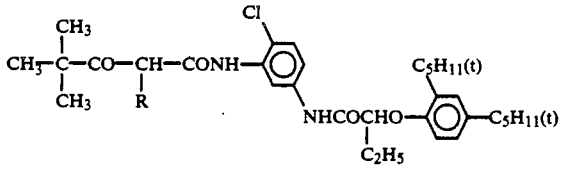

(ExM) Magenta coupler

Mixture (1:1 in molar ratio) of

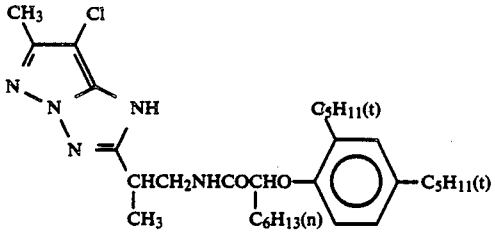

and

-continued

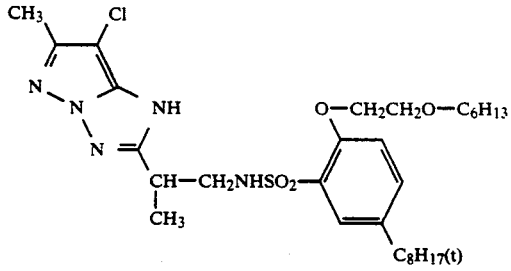

(ExC) Cyan coupler

Mixture (2:4:4 in weight ratio) of $R=C_2H_5$ and $C_4H_9$ of

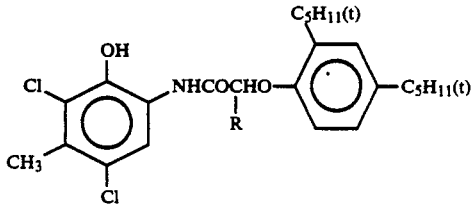

and

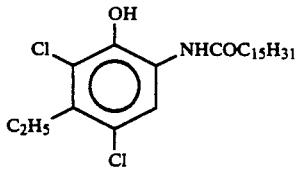

(Cpd-1) Image-dye stabilizer

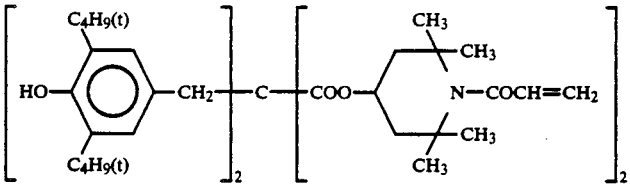

(Cpd-2) Image-dye stabilizer

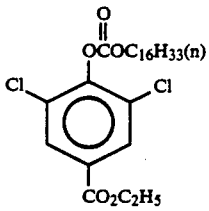

(Cpd-3) Image-dye stabilizer

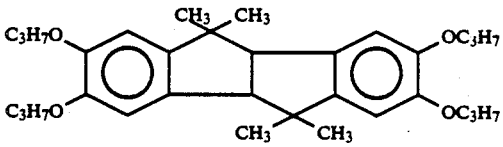

(Cpd-4) Image-dye stabilizer

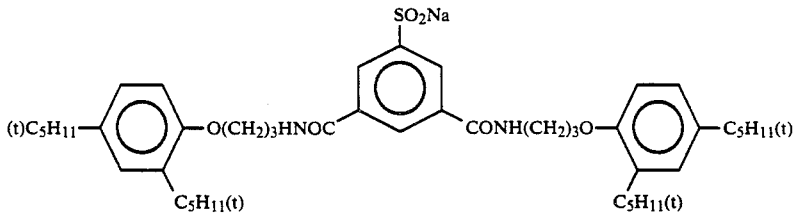
(Cpd-5) Color-mix inhibitor
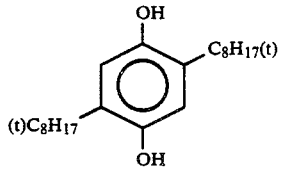
(Cpd-6) Image-dye stabilizer
Mixture (2:4:4 in weight ratio) of
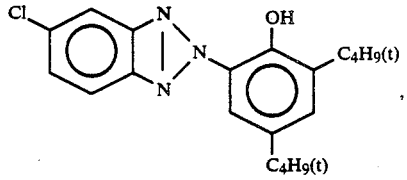
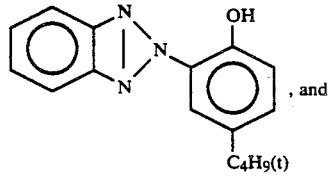
, and
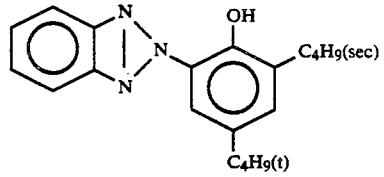
(Cpd-7) Image-dye stabilizer
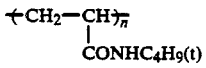
Average molecular weight: 60,000
(Cpd-8) Image-dye stabilizer
Mixture (1:1 in weight ratio) of
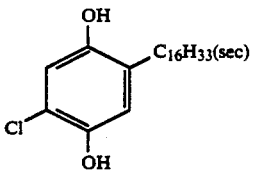
and
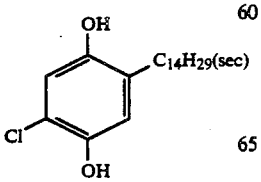
(Cpd-9) Image-dye stabilizer
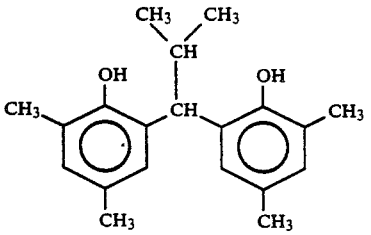
(UV-1) Ultraviolet ray absorber
Mixture (4:2:4 in weight ratio) of
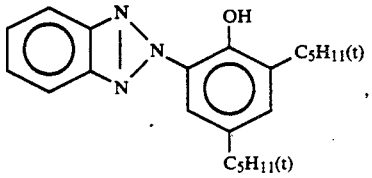
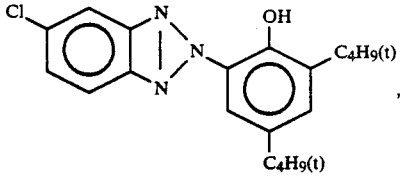
, and
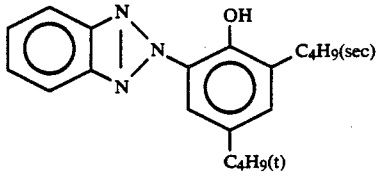
(Solv-1) Solvent
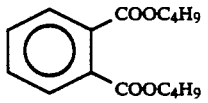
(Solv-2) Solvent
Mixture (2:1 in volume ratio) of
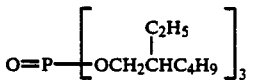
and -continued

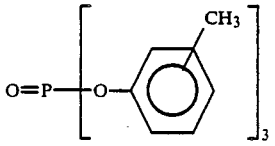

(Solv-4) Solvent

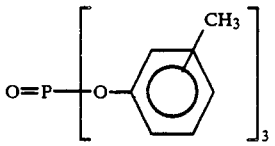

(Solv-5) Solvent

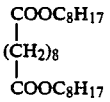

(Solv-6) Solvent

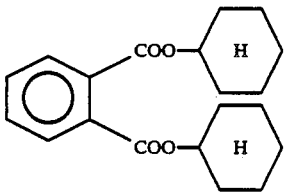

Each of photographic materials above described was subjected to a gradation exposure through three color separated filters for sensitometry using a sensitometer (FWH model made by Fuji Photo Film Co., Ltd., the color temperature of light source was 3200K).

After exposure to light, each sample was subjected to a continuous processing (running test) by the processing process shown below using a paper-processor, until a volume of color developer twice that of a tank had been replenished.

| Processing step | Temperature | Time | Replenisher Amount* | Tank Volume | Opened surface ratio |
|---|---|---|---|---|---|
| Color developing | 38° C. | 45 sec. | 109 ml | 17 l | see Table 1 |
| Bleach-fixing | 35° C. | 45 sec. | 215 ml | 17 l | 0.01 $cm^{-1}$ |
| Rinsing 1 | 35° C. | 20 sec. | — | 10 l | 0.01 $cm^{-1}$ |
| Rinsing 2 | 35° C. | 20 sec. | — | 10 l | 0.01 $cm^{-1}$ |
| Rinsing 3 | 35° C. | 20 sec. | 250 ml | 10 l | 0.01 $cm^{-1}$ |
| Drying | 80° C. | 60 sec. | | | |

Note:
*Replenisher amount is shown in ml per $m^2$ of photographic material. Rinsing steps were carried out in 3-tanks counter-flow mode from the tank of rinsing 3 towards the tank of rinsing 1. The opened surface ratio was changed by changing the size of floating lid.

The compositions of each processing solution were as follows:

-continued

| Color developer | Solution | isher |
|---|---|---|
| Water | 700 ml | 700 ml |
| Ethylenediamine-N,N,N',N'-tetramethylenephosphonic acid | 3.0 g | 3.3 g |
| Triethanolamine | 10 g | 12 g |
| Potassium bromide | 0.015 g | 0 g |
| Potassium chloride | 5.0 g | 0 g |
| Fluorescent brightening agent (WHITEX-4, made by Sumitomo Chemical Ind. Co.) | 1.0 g | 3.5 g |
| Potassium carbonate | 25 g | 25 g |
| Preservative | 50 mM | 50 mM |
| N-ethyl-N-(β-methanesulfonamidoethyl)-3-methyl-4-aminoaniline sulfonate | 5.5 g | 8.5 g |
| Water to make | 1000 ml | 1000 ml |
| pH (25° C.) | 10.05 | 10.55 |

Bleach-fixing solution
(Both tank solution and replenisher)

| | |
|---|---|
| Water | 400 ml |
| Ammonium thiosulfate (56 wt %) | 100 ml |
| Sodium sulfite | 17 g |
| Iron (III) ammonium ethylenediaminetetraacetate dihydrate | 55 g |
| Disodium ethylenediaminetetraacetate | 5 g |
| Glacial acetic acid | 9 g |
| Water to make | 1000 ml |
| pH (25° C.) | 5.40 |

Rinsing solution
Both tank solution and replenisher
Ion-exchanged water (Calcium and magnesium each are contained in an amount of 3 ppm or below)

The above color papers were exposed to light through an optical wedge and were processed in the beginning of and after the continuous processing.

The changes (ΔS) of the sensitivities of yellow, magenta, and cyan, and changes (γS) of the gradations were evaluated as the photographic properties after the continuous processing. Herein the sensitivity shows the value of logE at the point where the density was higher by 0.2 than the minimum density, and the gradation was indicated by the change of density from the point where the density was 0.5 to the density of the point on the higher exposure side by 0.3 in terms of logE. The results are shown in Table 1.

The opened surface ratios and the preservatives were as shown in Table 1. Although it is understood that when the opened surface ratio is made small the fluctuation of the photographic performances becomes small, it can be seen from the results in Table 1 that according to the constitution of the present invention wherein the opened surface ratio is made to be 0.015 $cm^{-1}$ or below and a preservative of the present invention is used, the fluctuation of the photographic performance can be made remarkably small.

Further, the same sample of color paper as the above was subjected to the exposure to light and the continuous processing in the same manner as the above described, except that ethylenediamine-N,N,N',N'-tetramethylene phosphonic acid in color developer (3.0 g/l in tank solution and 3.3 g/l in replenisher) was changed to (a) diethylenetriaminepentaacetic acid (0.4 g/l in tank solution and 0.4 g/l in replenisher), (b) N,N,N-tris(methylene phosphonic acid)(4.0 g/l in tank solution and 4.0 g/l in replenisher), and (c) 1-hydroxyethylidene-1,1-diphosphonic acid (0.5 g/l in tank solution and 0.5 g/l in replenisher), respectively. The same good results as those of this invention in Table 1 were obtained.

TABLE 1

| No. | Solution O.S.R.* ($cm^{-1}$) | Preservative | Change of Sensitivity (ΔS) Yellow | Magenta | Cyan | Change of Gradation (γS) Yellow | Magenta | Cyan | Remarks |
|---|---|---|---|---|---|---|---|---|---|
| 1 | 0.06 | Dimethyl-hydroxylamine | −0.14 | −0.13 | −0.12 | +0.15 | +0.12 | +0.12 | Comparative Example |
| 2 | 0.03 | Dimethyl-hydroxylamine | −0.13 | −0.12 | −0.11 | +0.14 | +0.11 | +0.11 | " |
| 3 | 0.01 | Dimethyl-hydroxylamine | −0.11 | −0.10 | −0.09 | +0.12 | +0.10 | +0.09 | " |
| 4 | 0.005 | Dimethyl-hydroxylamine | −0.10 | −0.09 | −0.08 | +0.10 | +0.09 | +0.08 | " |
| 5 | 0.06 | Diethyl-hydroxylamine | −0.12 | −0.12 | −0.11 | +0.13 | +0.12 | +0.11 | " |
| 6 | 0.03 | Diethyl-hydroxylamine | −0.11 | −0.10 | −0.10 | +0.12 | +0.11 | +0.10 | " |
| 7 | 0.01 | Diethyl-hydroxylamine | −0.10 | −0.09 | −0.09 | +0.10 | +0.09 | +0.09 | |
| 8 | 0.005 | Diethyl-hydroxylamine | −0.09 | −0.09 | −0.08 | +0.09 | +0.08 | +0.09 | " |
| 9 | 0.06 | I-1 | −0.06 | −0.07 | −0.07 | +0.06 | +0.07 | +0.08 | " |
| 10 | 0.03 | " | −0.05 | −0.05 | −0.06 | +0.05 | +0.06 | +0.07 | " |
| 11 | 0.01 | " | −0.02 | −0.02 | −0.01 | +0.02 | +0.02 | +0.02 | This Invention |
| 12 | 0.005 | " | −0.01 | −0.01 | −0.01 | +0.01 | +0.01 | +0.02 | " |
| 13 | 0.06 | I-2 | −0.06 | −0.07 | −0.06 | +0.07 | +0.07 | +0.06 | Comparative Example |
| 14 | 0.03 | " | −0.05 | −0.06 | −0.05 | +0.05 | +0.07 | +0.05 | " |
| 15 | 0.01 | " | −0.01 | −0.02 | −0.01 | +0.02 | +0.02 | +0.02 | This Invention |
| 16 | 0.005 | " | 0 | −0.01 | 0 | +0.01 | +0.01 | +0.01 | " |
| 17 | 0.06 | I-7 | −0.07 | −0.06 | −0.06 | +0.06 | +0.05 | +0.06 | Comparative Example |
| 18 | 0.03 | " | −0.06 | −0.05 | −0.05 | +0.05 | +0.05 | +0.05 | " |
| 19 | 0.01 | " | −0.02 | −0.01 | −0.01 | +0.01 | +0.02 | +0.02 | This Invention |
| 20 | 0.005 | " | −0.01 | 0 | 0 | 0 | +0.01 | +0.01 | " |
| 21 | 0.06 | I-12 | −0.07 | −0.06 | −0.05 | +0.06 | +0.07 | +0.06 | Comparative Example |
| 22 | 0.03 | " | −0.06 | −0.05 | −0.05 | +0.05 | +0.06 | +0.05 | " |
| 23 | 0.01 | " | −0.02 | −0.02 | −0.01 | +0.02 | +0.01 | +0.02 | This Invention |
| 24 | 0.005 | " | −0.01 | −0.01 | 0 | +0.01 | +0.01 | +0.01 | " |
| 25 | 0.06 | I-23 | −0.06 | −0.06 | −0.06 | +0.06 | +0.06 | +0.06 | Comparative Example |
| 26 | 0.03 | " | −0.05 | −0.05 | −0.06 | +0.05 | +0.05 | +0.05 | " |
| 27 | 0.01 | " | −0.02 | −0.02 | −0.02 | +0.02 | +0.02 | +0.01 | This Invention |
| 28 | 0.005 | " | −0.01 | −0.01 | −0.01 | +0.01 | +0.01 | 0 | " |
| 29 | 0.06 | I-53 | −0.06 | −0.07 | −0.07 | +0.06 | +0.07 | +0.08 | Comparative Example |
| 30 | 0.03 | " | −0.05 | −0.06 | −0.06 | +0.05 | +0.06 | +0.07 | " |
| 31 | 0.01 | " | −0.02 | −0.02 | −0.02 | +0.02 | +0.02 | +0.02 | This Invention |
| 32 | 0.005 | " | −0.01 | −0.01 | −0.01 | +0.01 | +0.01 | +0.02 | " |

Note:
*O.S.R. = Opened surface ratio

EXAMPLE 2

Using the same photographic material samples as Example 1, test for comparison was carried out in the same manner as in Example 1, except that preservative was changed to I-3, I-8, I-11, I-14, I-19, I-20, I-22, I-26, I-27, I-30, I-31, I-40, I-42, I-43, I-44, I-52, and I-54, respectively, and the opened surface ratio was changed to 0.03 $cm^{-1}$ and 0.01 $cm^{-1}$, respectively. Good results as in No. 11 of Example 1 were obtained according to the constitution of the present invention.

EXAMPLE 3

A multilayer color photographic paper was prepared by coating layers as hereinbelow described on a paper laminated on both sides with polyethylene. Coating solutions were prepared as follows:

Preparation of the first-layer coating solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved. The resulting solution was added to 450 ml of 10% aqueous gelatin solution containing sodium dodecylbenzene-sulfonate, and then the mixture was dispersed by a supersonic homogenizer. The resulting dispersion was mixed with and dissolved in 420 g of silver chloro-bromide emulsion (silver bromide: 0.7 mol %) containing a blue-sensitive sensitizing dye, described below, to prepare the first-layer coasting solution.

Coating solutions for the second to seventh layers were also prepared in the same manner as in the first layer coating solution. As a gelatin hardener for the respective layers, 1,2-bis(vinylsulfonyl)ethane was used.

As spectral sensitizers for the respective layers, the following compounds were used:

Blue-sensitive emulsion layer:

Anhydro-5,5'-dichloro-3,3'-disulfoethylthia-cyanine hydroxide

Green-sensitive emulsion layer:

Anhydro-9-ethyl-5,5'-diphenyl-3,3'-disulfoethylox-acarbocyanine hydroxide

Red-sensitive emulsion layer:

3,3'-Diethyl-5-methoxy-9,9'-(2,2'-dimethyl-1,3-propano)thiacarbocyanine iodide

As a stabilizer for the respective emulsion layer, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used:

[3-Carboxy-5-hydroxy-4-(3-(3-carboxy-5-oxo-1-(2,5-sulfonatophenyl)-2-pyrazoline-4-iridene)-1-propenyl)-1-pyrazolyl]benzene-2,5-disulfonate-disodium salt, N,N'-(4,8-Dihydroxy-9,10-dioxo-3,7-disulfonatoanthracene-1,5-diyl)bis(aminomethanesulfonate)-tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonato-sodium salt Composition of layers The composition of each layer is shown below. The figures represent coating amounts (g/m$^2$). The coating amounts of each silver halide emulsion is represented in terms of silver.

Base

Paper support laminated on both sides with polyethylene film and subjected to surface corona discharge treatment

| | |
|---|---|
| First Layer (Blue-sensitive emulsion layer): | |
| The above-described silver chlorobromide emulsion (AgBr: 0.7 mol %, cubic grain, average grain size: 0.9 μm) | 0.29 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color-mix preventing layer): | |
| Gelatin | 0.80 |
| Color-mix inhibitor (Cpd-2) | 0.055 |
| Solvent (Solv-1) | 0.03 |
| Solvent (Solv-2) | 0.15 |
| Third Layer (Green-sensitive emulsion layer): | |
| The above-described silver chlorobromide emulsion (AgBr: 0.7 mol %, cubic grain, average grain size: 0.45 μm) | 0.18 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.20 |
| Solvent (Solv-2) | 0.03 |
| Fourth Layer (Color-mix preventing layer): | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth Layer (Red-sensitive emulsion layer): | |
| The above-described silver chlorobromide emulsion (AgBr: 4 mol %, cubic grain, average grain size: 0.5 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| Sixth layer (Ultraviolet ray absorbing layer): | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh layer (Protective layer): | |
| Gelatin | 1.07 |

Compound used are as follows:

(ExY) Yellow coupler

α-Pivalyl-α-(3-benzyl-1-hidantoinyl)-2-chloro-5[β-(dodecylsulfonyl)butyramido]acetoanilide (ExM) Magenta coupler ((A-3)-5)

7-Chloro-6-isopropyl-3-{3-[2-butoxy-5-tert-octyl)-benzenesulfonyl]propyl}-1H-pyrazolo{5,1-c]-1,2,4-triazole (ExC-1) Cyan coupler 2-Pentafluorobenzamido-4-chloro-5[2-(2,4-di-tert-amylphenoxy)-3-methylbutyramidophenol (ExC-2) Cyan coupler 2,4-Dichloro-3-methyl-6-[α-(2,4-di-tert-amylphenoxy)butyramido]phenol (Cpd-1) Discoloration inhibitor

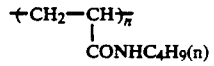

Average molecular weight: 80,000

(Cpd-2) Color-mix inhibitor 2,5-Di-tert-octylhydroquinone (Cpd-3) Discoloration inhibitor 7,7'-dihydroxy-4,4,4',4'-tetramethyl-2,2-spirocumarone (Cpd-4) Discoloration inhibitor N-(4-dodecyloxyphenyl)-morpholine (Cpd-5) Color-forming accelerator p-(p-Toluenesulfonamido)phenyl-dodecane (Solv-1) Solvent Di(2-ethylhexyl)phthalate (Solv-2) Solvent Dibutylphthalate (Solv-3) Solvent Di(i-nonyl)phthalate (Solv-4) Solvent N,N-diethylcarbonamido-methoxy-2,4-di-t-amylbenzene (UV-1) Ultraviolet absorber 2-(2-Hydroxy-3,5-di-tert-amylphenyl)benzotriazole (UV-2) Ultraviolet absorber 2-(2-Hydroxy-3,5-di-tert-butylphenyl)benzotriazole The thus-prepared samples were exposed imagewise to light and subjected to a continuous processing (running test) through the following steps by using a paper processor until a volume of color developer twice that of a tank had been replenished.

Separately, samples exposed to light through an wedge as the same manner in Example 1 were processed before and after the running test, and were evaluated changes of sensitivity and gradation between before and after running test in the same manner as in Example 1.

The photographic materials used, and the opened surface ratio and the preservatives are shown in Table 2.

Results are shown in Table 2.

| Processing steps | Temperature | Time | Replenisher Amount* | Tank Volume |
|---|---|---|---|---|
| Color Developing | 35° C. | 45 sec. | 161 ml | 17 l |
| Bleach-fixing | 30–36° C. | 45 sec. | 215 ml | 17 l |
| Stabilizing 1 | 30–37° C. | 20 sec. | — | 10 l |
| Stabilizing 2 | 30–37° C. | 20 sec. | — | 10 l |
| Stabilizing 3 | 30–37° C. | 20 sec. | — | 10 l |
| Stabilizing 4 | 30–37° C. | 30 sec. | 248 ml | 10 l |
| Drying | 70–85° C. | 60 sec. | | |

Note:

*Replenisher amount per 1 m$^2$ of the photographic material

The stabilizing solutions were used in a counter-current flowing system from the tank of stabilizing 4 toward the tank of stabilizing 1.

The compositions of the respective processing solution were as follows:

| Color developer | Tank solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.01 g | — |
| Potassium chloride | 2.0 g | — |
| Fluorescent brightening agent (4,4-diaminostilbene series) | 2.0 g | 2.5 g |
| Potassium carbonate | 25 g | 25 g |
| Preservative I, compound represented by formula (I), see Table 2 | 45 mmol | 45 mmol |
| N-ethyl-N-(β-methanesulfonamidoethyl)-3-methyl-4-aminoaniline sulfate | 5.0 g | 7.0 g |
| Water to make | 1000 ml | 1000 ml |
| pH (25° C.) | 10.05 | 10.45 |

Bleach-fixing solution

| (both tank solution and replenisher) | |
|---|---|
| Water | 400 ml |
| Ammonium thiosulfate (56 wt. %) | 100 ml |
| Sodium sulfite | 17 g |
| Iron (III) ammonium ethylenediaminetetraacetate | 55 g |
| Disodium ethylenediaminetetraacetate | 5 g |
| Glacial acetic acid | 9 g |
| Water to make | 1000 ml |
| pH (25° C.) | 5.40 |

Stabilizing solution

-continued

| (both tank solution and replenisher) | |
|---|---|
| Formalin (37%) | 0.1 g |
| Formalin-sulfic acid adduct | 0.7 g |
| 5-Chloro-2-methyl-4-isothiazoline-3-one | 0.02 g |
| 2-Methyl-4-isothiazoline-3-one | 0.01 g |
| Copper sulfate | 0.005 g |
| Water to make | 1000 ml |
| pH (25° C.) | 4.0 |

TABLE 2

| No. | Solution O.S.R.* (cm$^{-1}$) | Preservative | Change of Sensitivity (ΔS) Yellow | Magenta | Cyan | Change of Gradation (γS) Yellow | Magenta | Cyan | Remarks |
|---|---|---|---|---|---|---|---|---|---|
| 33 | 0.06 | Dimethylhydroxylamine | −0.12 | −0.13 | −0.12 | +0.14 | +0.12 | +0.13 | Comparative Example |
| 34 | 0.03 | Dimethylhydroxylamine | −0.11 | −0.11 | −0.11 | +0.13 | +0.11 | +0.11 | " |
| 35 | 0.01 | Dimethylhydroxylamine | −0.10 | −0.10 | −0.09 | +0.12 | +0.10 | +0.09 | " |
| 36 | 0.005 | Dimethylhydroxylamine | −0.10 | −0.09 | −0.08 | +0.10 | +0.09 | +0.08 | " |
| 37 | 0.06 | Diethylhydroxylamine | −0.13 | −0.12 | −0.11 | +0.12 | +0.12 | +0.11 | " |
| 38 | 0.03 | Diethylhydroxylamine | −0.12 | −0.11 | −0.10 | +0.11 | +0.11 | +0.10 | " |
| 39 | 0.01 | Diethylhydroxylamine | −0.10 | −0.09 | −0.09 | +0.10 | +0.10 | +0.09 | " |
| 40 | 0.005 | Diethylhydroxylamine | −0.09 | −0.09 | −0.08 | +0.09 | +0.08 | +0.09 | " |
| 41 | 0.06 | I-3 | −0.06 | −0.06 | −0.07 | +0.06 | +0.07 | +0.06 | " |
| 42 | 0.03 | " | −0.05 | −0.05 | −0.06 | +0.05 | +0.06 | +0.05 | " |
| 43 | 0.01 | " | −0.02 | −0.02 | −0.01 | +0.02 | +0.02 | +0.02 | This Invention |
| 44 | 0.005 | " | −0.01 | −0.01 | −0.01 | +0.01 | +0.01 | +0.01 | " |
| 45 | 0.06 | I-7 | −0.06 | −0.07 | −0.06 | +0.06 | +0.07 | +0.06 | Comparative Example |
| 46 | 0.03 | " | −0.05 | −0.06 | −0.05 | +0.05 | +0.06 | +0.05 | " |
| 47 | 0.01 | " | −0.01 | −0.02 | −0.01 | +0.02 | +0.02 | +0.02 | This Invention |
| 48 | 0.005 | " | −0.01 | −0.01 | 0 | +0.01 | +0.01 | +0.01 | " |
| 49 | 0.06 | I-11 | −0.07 | −0.06 | −0.06 | +0.06 | +0.07 | +0.06 | Comparative Example |
| 50 | 0.03 | " | −0.06 | −0.05 | −0.05 | +0.05 | +0.06 | +0.05 | " |
| 51 | 0.01 | " | −0.02 | −0.01 | −0.01 | +0.02 | +0.02 | +0.02 | This Invention |
| 52 | 0.005 | " | −0.01 | 0 | −0.01 | +0.01 | +0.01 | +0.01 | " |
| 53 | 0.06 | I-14 | −0.06 | −0.06 | −0.05 | +0.06 | +0.07 | +0.06 | Comparative Example |
| 54 | 0.03 | " | −0.05 | −0.05 | −0.04 | +0.05 | +0.06 | +0.05 | " |
| 55 | 0.01 | " | −0.01 | −0.02 | −0.01 | +0.02 | +0.01 | +0.02 | This Invention |
| 56 | 0.005 | " | −0.01 | −0.01 | 0 | +0.01 | 0 | +0.01 | " |
| 57 | 0.06 | I-26 | −0.06 | −0.06 | −0.07 | +0.07 | +0.06 | +0.06 | Comparative Example |
| 58 | 0.03 | " | −0.05 | −0.05 | −0.06 | +0.06 | +0.05 | +0.05 | " |
| 59 | 0.01 | " | −0.02 | −0.02 | −0.02 | +0.02 | +0.02 | +0.01 | This Invention |
| 60 | 0.005 | " | −0.01 | −0.01 | −0.01 | +0.01 | +0.01 | 0 | " |
| 61 | 0.06 | I-44 | −0.06 | −0.07 | −0.07 | +0.06 | +0.07 | +0.07 | Comparative Example |
| 62 | 0.03 | " | −0.05 | −0.06 | −0.06 | +0.05 | +0.06 | +0.06 | " |
| 63 | 0.01 | " | −0.02 | −0.02 | −0.02 | +0.02 | +0.02 | +0.02 | This Invention |
| 64 | 0.005 | " | −0.01 | −0.01 | −0.01 | 0 | +0.01 | +0.01 | " |

Note:
*O.S.R. = Opened surface ratio

As is apparent from Table 2, it can be understood that according to the constitution of the present invention, good results can be obtained.

That is, by lowering the opened surface ratio, the fluctuation of the photographic performance could be made small, and when that was combined with the use of compounds of formula (I) of the present invention, the fluctuation was made considerably smaller.

Further, the same sample of color paper as the above was subjected to the exposure to light and the continuous processing in the same manner as the above described, except that ethylenediamine-N,N,N',N'-tetramethylene phosphonic acid in color developer (1.5 g/l in tank solution and 2.0 g/l in replenisher) was changed to (a) diethylenetriaminepentaacetic acid (0.4 g/l in tank solution and 0.4 g/l in replenisher), (b) N,N,N-tris(methylene phosphonic acid) (4.0 g/l in tank solution and 4.0 g/l in replenisher), and (c) 1-hydroxyethylidene-1,1-diphosphonic acid (0.5 g/l in tank solution and 0.5 g/l in replenisher), respectively. The same good results as those of this invention in Table 2 were obtained.

EXAMPLE 4

A photographic material was prepared in the same manner as in Example 1, except that the mixture of the following compounds in a ratio of 1:1 was used in stead of dye stabilizer (Cpd-8) in Example 1:

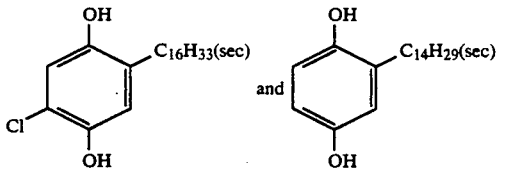

(a mixture of 1:1)

and the following dyes were used as dye for preventing the irradiation:

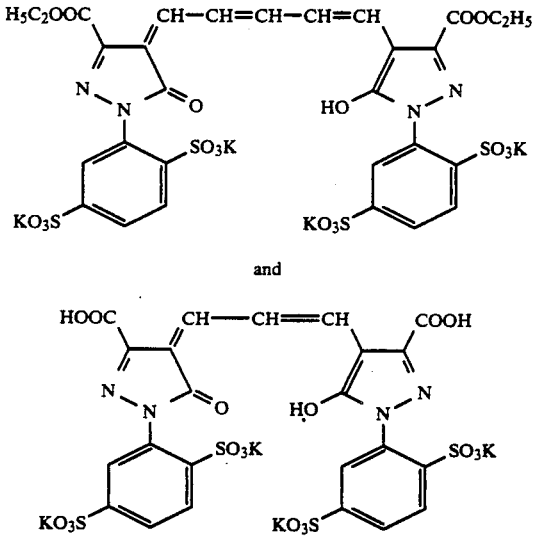

The thus-prepared photographic material was subjected to the similar comparison test as in Example 1, except that compound I-1, I-2, I-7, I-22, I-23, or I-53 was used as the preservative, respectively. Results obtained in this evaluation showed that good results could be attained according to the present invention.

EXAMPLE 5

The photographic material prepared in the same manner as in Example 1 was imagewise exposed to light and subjected to a continuous processing (running test) through the following steps by using an automatic developing processor for color paper until a volume of color developer twice that of a tank had been replenished. Separately, samples exposed to light as the same manner in Example 1 were processed before and after the running test.

| Processing steps | Temperature | Time | Replenisher Amount* | Tank Volume | Opend surface ratio |
|---|---|---|---|---|---|
| Color Developing | see Table 3 | see Table 3 | 109 ml | 17 l | 0.01 $cm^{-1}$ |
| Bleach-fixing | 35° C. | 45 sec. | 219 ml | 17 l | 0.01 $cm^{-1}$ |
| Rinsing 1 | 35° C. | 20 sec. | — | 10 l | 0.01 $cm^{-1}$ |
| Rinsing 2 | 35° C. | 20 sec. | — | 10 l | 0.01 $cm^{-1}$ |
| Rinsing 3 | 35° C. | 20 sec. | 250 ml | 10 l | 0.01 $cm^{-1}$ |
| Drying | 80° C. | 60 sec. | | | |

Note:
*Replenisher amount is shown in ml per 1 $m^2$ of the photographic material. Rinsing steps were carried out in 3-tank counter-flow mode from the tank of rinsing 3 towards the tank of rinsing 1.

The compositions of the respective processing solution were as follows:

| | Tank solution | Replenisher |
|---|---|---|
| Color developer | | |
| Water | 700 ml | 700 ml |
| Ethylenediamine-N,N,N',N'-tetrakis-(methylene phosphonic acid) | 3.0 g | 3.3 g |
| Potassium bromide | 0.015 g | 0 g |
| Potassium chloride | 5 g | 0 g |
| Triethanolamine | 10 g | 12 g |
| Potassium carbonate | 25 g | 25 g |
| Fluorescent brightening agent (WHITEX-4, made by Sumitomo Chemical Ind.) | 1.0 g | 3.5 g |
| Additive (see Table 3) | 50 mM | 70 mM |
| N-methyl-N-(β-methanesulfonamidoethyl)-3-methyl-4-aminoaniline sulfate | 5.5 g | 8.5 g |
| Water to make | 1000 ml | 1000 ml |
| pH (25° C.) | 10.05 | 10.55 |
| Bleach-fixing solution (both tank solution and replenisher) | | |
| Water | 400 ml | |
| Ammonium thiosulfate (700 g/l) | 100 ml | |
| Sodium sulfite | 17 g | |
| Iron (III) ammonium ethylenediaminetetraacetate | 55 g | |
| Disodium ethylenediaminetetraacetate | 5 g | |
| Glacial acetic acid | 9 g | |
| Water to make | 1000 ml | |
| pH (25° C.) | 5.40 | |

Rinsing solution
(both tank solution and replenisher)
Ion-exchanged water (concentrations of calcium and magnesium were each 3 ppm or below)

The above-described color photographic paper was subjected to an exposure to light through an optical wedge and to processings before and after the continuous processing.

The change (ΔS) of the sensitivity of magenta and the change of maximum density (Dmax) of magenta were evaluated as the photographic properties after the continuous processing. The sensitivity was determined by the same manner as in Example 1.

TABLE 3

| No. | Color-Developing Temperature (°C.) | Color-Developing Time (sec) | Additive | Max. Density of Magenta Dmax | Sensitivity Change of Magenta(ΔS) | Remarksdmax |
|---|---|---|---|---|---|---|
| 65 | 35 | 35 | Diethylhydroxylamine | 2.02 | −0.08 | Comparative Example |
| 66 | 40 | 20 | " | 1.93 | −0.12 | " |

TABLE 3-continued

| No. | Color-Developing Temperature (°C.) | Color-Developing Time (sec) | Additive | Max. Density of Magenta Dmax | Sensitivity Change of Magenta(ΔS) | Remarksdmax |
|---|---|---|---|---|---|---|
| 67 | 35 | 35 | Exemplified Compound (1) | 2.46 | 0 | This Invention |
| 68 | 40 | 20 | " | 2.40 | −0.01 | " |
| 69 | 35 | 35 | Exemplified Compound (2) | 2.47 | −0.01 | " |
| 70 | 40 | 20 | " | 2.38 | −0.01 | " |
| 71 | 35 | 35 | Exemplified Compound (3) | 2.46 | 0 | " |
| 72 | 40 | 20 | " | 2.37 | −0.01 | " |
| 73 | 35 | 35 | Exemplified Compound (6) | 2.47 | −0.01 | " |
| 74 | 40 | 20 | " | 2.34 | −0.02 | " |
| 75 | 35 | 35 | Exemplified Compound (7) | 2.46 | 0 | " |
| 76 | 40 | 20 | " | 2.32 | −0.01 | " |
| 77 | 35 | 35 | Exemplified Compound (8) | 2.47 | −0.01 | " |
| 78 | 40 | 20 | " | 2.39 | −0.01 | " |
| 79 | 35 | 35 | Exemplified Compound (12) | 2.46 | 0 | " |
| 80 | 40 | 20 | " | 2.32 | −0.01 | " |
| 81 | 35 | 35 | Exemplified Compound (13) | 2.47 | 0 | " |
| 82 | 40 | 20 | " | 2.30 | −0.02 | " |
| 83 | 35 | 35 | Exemplified Compound (21) | 2.46 | −0.01 | " |
| 84 | 40 | 20 | " | 2.33 | −0.01 | " |
| 85 | 35 | 35 | Exemplified Compound (24) | 2.47 | −0.01 | " |
| 86 | 40 | 20 | " | 2.35 | −0.01 | " |
| 87 | 35 | 35 | Exemplified Compound (38) | 2.46 | 0 | " |
| 88 | 40 | 20 | " | 2.37 | −0.01 | " |
| 89 | 35 | 35 | Exemplified Compound (53) | 2.47 | −0.01 | " |
| 90 | 40 | 20 | " | 2.30 | −0.02 | " |

As is apparent from the result in Table 3, when the conventional diethylhydroxylamine was used as an additive, Dmax of magenta decreased and the change of sensitivity of magenta increased by shortening the conventional processing time to 35 sec. or below (Nos. 65 and 66), but when compounds of the present invention were used, enough color-forming was attained and the change of sensitivity was small even if the processing time was shortened to 35 sec. or 25 sec. (Nos. 67 to 90).

Further, the same sample of color paper as the above was subjected to the exposure to light and the continuous processing in the same manner as the above described, except that ethylenediaminetetrakis(methylene phosphonic acid) in color developer (3.0 g/l in tank solution and 3.3 g/l in replenisher) was changed to (a) ethylenediaminetetraacetic acid (3.0 g/l in tank solution and 3.0 g/l in replenisher), and (b) disodium salt of 1,2-dihydroxybenzen-3,5-disulfonic acid (0.5 g/l in tank solution and 0.5 g/l in replenisher), respectively. The same good results as those of this invention in Table 3 were obtained.

EXAMPLE 6

A multilayer color photographic paper was prepared by the same manner as in Example 3 and subjected to the running test in the same procedure as Example 5. Separately, it was subjected the exposure to light by the same manner as in Example 1 and processed before and after running test.

The change of gradation (Δγ) of magenta and the change of maximum density (Dmax) were evaluated as the photographic properties after the continuously processing. The gradation was indicated by the change of density from the point where the density was 0.5 to the point where the density was on the exposure side 0.3 higher in terms of logE than that. Results are shown in Table 4.

TABLE 3

| No. | Color-Developing Temperature (°C.) | Color-Developing Time (sec) | Additive | Max. Density of Magenta Dmax | Gradation Change of Magenta(Δγ) | Remarks |
|---|---|---|---|---|---|---|
| 91 | 35 | 35 | Diethylhydroxylamine | 1.98 | +0.08 | Comparative Example |
| 92 | 40 | 20 | " | 1.85 | +0.12 | " |
| 93 | 35 | 35 | Exemplified Compound (1) | 2.46 | 0 | This Invention |
| 94 | 40 | 20 | " | 2.39 | +0.01 | " |
| 95 | 35 | 35 | Exemplified Compound (2) | 2.44 | 0 | " |
| 96 | 40 | 20 | " | 2.35 | +0.01 | " |
| 97 | 35 | 35 | Exemplified Compound (3) | 2.43 | 0 | " |
| 98 | 40 | 20 | " | 2.33 | +0.01 | " |
| 99 | 35 | 35 | Exemplified Compound (7) | 2.45 | 0 | " |
| 100 | 40 | 20 | " | 2.36 | +0.02 | " |
| 101 | 35 | 35 | Exemplified Compound (12) | 2.45 | 0 | " |
| 102 | 40 | 20 | " | 2.35 | +0.01 | " |
| 103 | 35 | 35 | Exemplified Compound (14) | 2.43 | +0.01 | " |
| 104 | 40 | 20 | " | 2.36 | +0.02 | " |
| 105 | 35 | 35 | Exemplified Compound (17) | 2.44 | 0 | " |
| 106 | 40 | 20 | " | 2.34 | +0.01 | " |
| 107 | 35 | 35 | Exemplified Compound (24) | 2.45 | 0 | " |
| 108 | 40 | 20 | " | 2.36 | +0.01 | " |
| 109 | 35 | 35 | Exemplified Compound (30) | 2.46 | 0 | " |
| 110 | 40 | 20 | " | 2.31 | +0.01 | " |
| 111 | 35 | 35 | Exemplified Compound (38) | 2.47 | +0.01 | " |
| 112 | 40 | 20 | " | 2.32 | +0.02 | " |
| 113 | 35 | 35 | Exemplified Compound (53) | 2.48 | 0 | " |
| 114 | 40 | 20 | " | 2.32 | +0.01 | " |

TABLE 3-continued

| No. | Color-Developing Temperature (°C.) | Color-Developing Time (sec) | Additive | Max. Density of Magenta Dmax | Gradation Change of Magenta(Δγ) | Remarks |
|---|---|---|---|---|---|---|
| 115 | 35 | 35 | Exemplified Compound (54) | 2.43 | +0.01 | " |
| 116 | 40 | 20 | " | 2.30 | +0.01 | " |

As is apparent from the results in Table 4, when the conventional diethylhydroxylamine was used as an additive, Dmax of magenta increased by shortening the conventional processing time to 35 sec. or below (Nos. 91 and 92), but when compounds of the present invention were used, enough color-forming was attained and the change of gradation was small even if the processing time was shortened to 35 sec. or 25 sec. (Nos. 93 to 116).

EXAMPLE 7

The photographic material prepared in Example 1 was subjected to an imagewise exposure to light and to a continuous processing (running test) through the following steps by using an automatic developing processor for color paper until a volume of color developer twice that of a tank had been replenished. Separately, samples exposed to light as the same manner in Example 1 were processed before and after the running test.

| Processing steps | Temperature | Time | Replenisher Amount* | Tank Volume |
|---|---|---|---|---|
| Color developing | 38° C. | 35 sec. | (a) 145 ml | 17 l |
| | 39° C. | 35 sec. | (b) 105 ml | 17 l |
| | 40° C. | 35 sec. | (c) 50 ml | 17 l |
| Bleach-fixing | 35° C. | 45 sec. | 219 ml | 17 l |
| Rinsing (1) | 35° C. | 20 sec. | — | 10 l |
| Rinsing (2) | 35° C. | 20 sec. | — | 10 l |
| Rinsing (3) | 35° C. | 20 sec. | 250 ml | 10 l |
| Drying | 80° C. | 60 sec. | | |

Note:
*Replenisher amount is shown in ml per 1 $m^2$ of the photographic material. Rinsing steps were carried out in 3-tank counter-flow mode from the tank of rinsing (3) towards the tank of rinsing (1). The opened surface ratios of color developers (a), (b), and (c) were 0.005 $cm^{-1}$ in average, respectively.

The compositions of the respective processing solution were as follows:

| Color developer | Tank Solution (a) | Tank Solution (b) | Tank Solution (c) | Replenisher (a) | Replenisher (b) | Replenisher (c) |
|---|---|---|---|---|---|---|
| Water | 700 ml | 700 ml | 700 ml | 700 ml | 700 ml | 700 ml |
| Ethylenediamine-N,N,N',N'-tetrakismethylenephosphonic acid | 3.0 g | 3.0 g | 3.0 g | 3.3 g | 3.3 g | 3.3 g |
| Triethanolamine | 10 g | 10 g | 10 g | 11 g | 12 g | 13 g |
| Potassium bromide | 0.01 g | 0.15 g | 0.02 g | 0 | 0 | 0 |
| Potassium chloride | 3.0 g | 5.0 g | 8.0 g | 0 | 0 | 0 |
| Fluorescent brightening agent (WHITEX-4, made by Sumitomo Chemical Ind. Co.) | 1.0 g | 1.0 g | 1.0 g | 2.5 g | 3.5 g | 4.5 g |
| Potassium carbonate | 25 g | 25 g | 25 g | 25 g | 25 g | 25 g |
| Additive (see Table 5) | 50 mM | 50 mM | 50 mM | 65 mM | 70 mM | 80 mM |
| N-ethyl-N-(β-methanesulfonamidoethyl)-3-methyl-4-aminoaniline sulfonate | 5.0 g | 5.5 g | 6.0 g | 7.0 g | 8.5 g | 9.5 g |
| Water to make 1000 ml | 1000 ml | 1000 ml | 1000 ml | 1000 ml | 1000 ml | 1000 ml |
| pH (25° C.) | 10.05 | 10.05 | 10.15 | 10.45 | 10.55 | 10.65 |

| Bleach-fixing solution (both tank solution and replenisher) | |
|---|---|
| Water | 400 ml |
| Ammonium thiosulfate (700 g/l) | 400 ml |
| Sodium sulfite | 17 g |
| Iron (III) ammonium ethylenediaminetetraacetate | 55 g |
| Disodium ethylenediaminetetraacetate | 5 g |
| Glacial acetic acid | 9 g |
| Water to make | 1000 ml |
| pH (25° C.) | 5.40 |

Rinsing solution
(both tank solution and replenisher)
Ion-exchanged water (concentrations of calcium and magnesium were each 3 ppm or below)

Maximum density (Dmax) of yellow, magenta, and cyan, after running test, were determined and change of the sensitivity (ΔS) of cyan after running test were calculated. The sensitivity was determined by the same manner as in Example 1. Results are shown in Table 5.

TABLE 5

| No. | Color-Developing Temp. (°C.) | Color-Developing Time (sec) | Color-Developing R.Amount* (ml) | Additive | Maximum Density (Dmax) Yellow | Maximum Density (Dmax) Magenta | Maximum Density (Dmax) Cyan | Sensitivity Change of Cyan(ΔS) | Remarks |
|---|---|---|---|---|---|---|---|---|---|
| 117 | 38 | 35 | 145 | Diethylhydroxylamine | 2.01 | 2.29 | 2.00 | −0.05 | Comparative Example |
| 118 | 39 | 35 | 105 | " | 1.97 | 2.23 | 1.94 | −0.07 | " |
| 119 | 41 | 35 | 50 | " | 1.85 | 2.15 | 1.87 | −0.03 | " |
| 120 | 38 | 35 | 145 | Compound (2) | 2.24 | 2.51 | 2.19 | 0 | This Invention |
| 121 | 39 | 35 | 105 | " | 2.21 | 2.50 | 2.16 | −0.01 | " |
| 122 | 41 | 35 | 50 | " | 2.13 | 2.43 | 2.06 | −0.02 | " |

TABLE 5-continued

| No. | Color-Developing Temp. (°C.) | Time (sec) | R.Amount* (ml) | Additive | Maximum Density (Dmax) Yellow | Magenta | Cyan | Sensitivity Change of Cyan(ΔS) | Remarks |
|---|---|---|---|---|---|---|---|---|---|
| 123 | 38 | 35 | 145 | Compound (6) | 2.22 | 2.52 | 2.15 | −0.01 | " |
| 124 | 39 | 35 | 105 | " | 2.20 | 2.50 | 2.12 | −0.02 | " |
| 125 | 41 | 35 | 50 | " | 2.12 | 2.45 | 2.07 | −0.03 | " |
| 126 | 38 | 35 | 145 | Compound (7) | 2.23 | 2.51 | 2.19 | 0 | " |
| 127 | 39 | 35 | 105 | " | 2.19 | 2.50 | 2.14 | −0.01 | " |
| 128 | 41 | 35 | 50 | " | 2.10 | 2.44 | 2.08 | −0.03 | " |
| 129 | 38 | 35 | 145 | Compound (12) | 2.25 | 2.53 | 2.17 | −0.01 | " |
| 130 | 39 | 35 | 105 | " | 2.23 | 2.51 | 2.11 | −0.01 | " |
| 131 | 41 | 35 | 50 | " | 2.12 | 2.42 | 2.07 | −0.03 | " |
| 132 | 38 | 35 | 145 | Compound (17) | 2.20 | 2.51 | 2.17 | −0.01 | " |
| 133 | 39 | 35 | 105 | " | 2.20 | 2.46 | 2.14 | −0.01 | " |
| 134 | 41 | 35 | 50 | " | 2.12 | 2.39 | 2.09 | −0.03 | " |
| 135 | 38 | 35 | 145 | Compound (21) | 2.23 | 2.51 | 2.16 | −0.01 | " |
| 136 | 39 | 35 | 105 | " | 2.21 | 2.48 | 2.14 | −0.01 | " |
| 137 | 41 | 35 | 50 | " | 2.11 | 2.40 | 2.08 | −0.03 | " |
| 138 | 38 | 35 | 145 | Compound (30) | 2.27 | 2.53 | 2.17 | 0 | " |
| 139 | 39 | 35 | 105 | " | 2.23 | 2.50 | 2.11 | −0.01 | " |
| 140 | 41 | 35 | 50 | " | 2.13 | 2.48 | 2.09 | −0.02 | " |
| 141 | 38 | 35 | 145 | Compound (53) | 2.24 | 2.53 | 2.15 | −0.01 | " |
| 142 | 39 | 35 | 105 | " | 2.21 | 2.50 | 2.12 | −0.02 | " |
| 143 | 41 | 35 | 50 | " | 2.16 | 2.42 | 2.10 | −0.02 | " |
| 144 | 38 | 35 | 145 | Compound (54) | 2.24 | 2.49 | 2.16 | 0 | " |
| 145 | 39 | 35 | 105 | " | 2.22 | 2.45 | 2.12 | −0.01 | " |
| 146 | 41 | 35 | 50 | " | 2.13 | 2.36 | 2.08 | −0.03 | " |

Note:
*Replenisher amount is shown in ml per square meter of photographic material.

As is apparent from the result in Table 5, when the conventional diethylhydroxylamine was used as an additive, each Dmax of yellow, magenta, and cyan decreased and the change of sensitivity of cyan increased by shortening the conventional processing time to 35 sec. and lowering the replenisher amount (Nos. 117 to 119), but when compounds of the present invention were used, enough color-forming was attained and the change of sensitivity was small even if the processing time was shortened to 35 sec. and the replenisher amount decreased (Nos. 120 to 146).

EXAMPLE 8

Photographic material prepared in Example 1 was subjected to the running test in which the replenisher amount of color developer was as shown in Table 6 and the concentrations of KBr and KCl in developing bath were as shown in Table 6. After the running test the change of each sensitivity of yellow and magenta was determined.

Next, the photographic material was subjected to a gradation exposure for sensitometry using a sensitometer (FMH model made by Fuji Photo Film Co., Ltd., the color temperature of light source was 3200K). At that time, the exposure was carried out in such a manner that the exposure was 250 CMS with the exposure time being 0.1 sec.

After exposure for sensitometry, photographic material was processed using processing solutions after running test and the minimum density (Dmin) of magenta was measured by Macbeth densitometer.

Results are shown in Table 6.

TABLE 6

| No. | Solution O.S.R.* ($cm^{-1}$) | Preservative | Color-Developer KBr (mol) | KCl (mol) | Replenisher amount | Change of Sensitivity(ΔS) Yellow | Magenta | Dmin Magenta | Remarks |
|---|---|---|---|---|---|---|---|---|---|
| 91 | 0.01 | I - 7 | $3 \times 10^{-5}$ | $7 \times 10^{-2}$ | 300 ml | −0.02 | −0.01 | −0.16 | This Invention |
| 92 | 0.01 | " | $2 \times 10^{-4}$ | " | 70 ml | −0.02 | −0.01 | −0.13 | |
| 93 | 0.01 | " | $9 \times 10^{-4}$ | " | 70 ml | −0.04 | −0.03 | −0.13 | " |
| 94 | 0.01 | " | $2 \times 10^{-3}$ | " | 40 ml | −0.05 | −0.04 | −0.13 | " |
| 95 | 0.01 | " | $2 \times 10^{-4}$ | $2 \times 10^{-2}$ | 200 ml | −0.01 | −0.01 | −0.15 | " |
| 96 | 0.01 | " | " | $2 \times 10^{-1}$ | 70 ml | −0.03 | −0.03 | −0.13 | " |
| 97 | 0.01 | " | " | $5 \times 10^{-1}$ | 40 ml | −0.04 | −0.03 | −0.13 | " |

Note:
*Opened surface ratio

As is apparent from the results of Table 6, it can be noted that when chloride ions and bromide ions of $4.0 \times 10^{-2}$ to $1.0 \times 10^{-1}$ mol/l and $1.0 \times 10^{-4}$ to $3.0 \times 10^{-4}$ mol/l, respectively, are contained in the color developer letter photographic properties can be attained.

Having described our invention as related to the embodiment, it is our intention that the invention be not limited by any of the details of the description, unless otherwise specified, but rather be construed broadly within its spirit and scope as set out in the accompanying claims.

What we claimed is:

1. A method for processing a silver halide color photographic material which comprises processing an image-wise exposed photographic material with a color developer containing an aromatic primary amine color developing agent and at least one of compounds represented by the following formula (I):

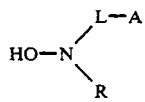

Formula (I)

wherein L represents an alkylene group, A represents a carboxyl group, a sulfo group, a phosphono group, a phosphinic acid residue, a hydroxyl group, an amino group, an ammonio group, a carbamoyl group, a sulfamoyl group, or an alkylsulfonyl group, and R represents a hydrogen atom or an alkyl group, by using an automatic processor in which the opened surface ratio of the color developer in the tank is 0.015 $cm^{-1}$ or below.

2. The method as claimed in claim 1, wherein the silver halide color photographic material is processed with a color developer containing chloride ions of $1.0\times10^{-2}$ to $1.5\times10^{-1}$ mol/l and bromide ions of $3.0\times10^{-5}$ to $1.0\times10^{-3}$ mol/l.

3. The method as claimed in claim 1, wherein the silver halide color photographic material is processed with a color developer containing chloride ions of $4.0\times10^{-2}$ to $1.0\times10^{-1}$ mol/l and bromide ions of $1.0\times10^{-4}$ to $3.0\times10^{-4}$ mol/l.

4. The method as claimed in claim 1, wherein the opened surface area of the color developer is 0.001 to 0.01 $cm^{-1}$.

5. The method as claimed in claim 1, wherein L in formula (I) represents a straight-chain or branched-chain alkylene group having 1 to 10 carbon atoms.

6. The method as claimed in claim 1, wherein A in formula (I) is selected from the group consisting of a carboxyl group, a sulfo group, a hydroxyl group, a phosphono group, and carbamoyl group.

7. The method as claimed in claim 1, wherein R in formula (I) represents an optionally substituted straight-chain or branched chain alkyl group having 1 to 10 carbon atoms.

8. The method as claimed in claim 1, wherein R in formula (I) is selected from the group consisting of a hydrogen atom, a methyl group, an ethyl group, a propyl group, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group.

9. The method as claimed in claim 1, wherein L and R in formula (I) bond together to form a ring.

10. The method as claimed in claim 1, wherein the compound represented by formula (I) is contained 0.1 to 50 g per liter of the color developer.

11. The method as claimed in claim 1, wherein the color developer further contains a compound represented by the following formula (A):

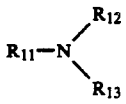

Formula (A)

wherein $R_{11}$ represents a hydroxyalkyl group having 2 to 6 of carbon atoms, $R_{12}$ and $R_{13}$ each represent a hydrogen atom, an alkyl group having 1 to 6 carbon atoms, a hydroxyalkyl group having 2 to 6 of carbon atoms, a benzyl group, or formula

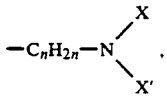

(wherein n is an integer of 1 to 6, and X and X' each represent a hydrogen atom, an alkyl group having 1 to 6 carbon atoms, a hydroxyalkyl group having 2 to 6 of carbon atoms).

12. The method as claimed in claim 1, wherein the color developer further contains a compound represented by formula (B-I) or (B-II):

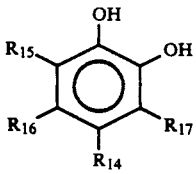

Formula (B-I)

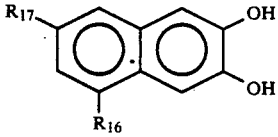

Formula (B-II)

wherein $R_{14}$, $R_{15}$, $R_{16}$, and $R_{17}$, each represent a hydrogen atom, a halogen atom, a sulfonic group, an alkyl group having 1 to 7 carbon atoms, $-OR_{18}$, $-COOR_{19}$,

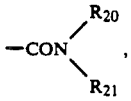

or phenyl group; and $R_{18}$, $R_{19}$, $R_{20}$, and $R_{21}$ each represent a hydrogen atom, an alkyl group having 1 to 18 carbon atoms, provided that when $R_{15}$ represents —OH or a hydrogen atom, $R_{14}$ represents a halogen atom, sulfonic group, an alkyl group having 1 to 7 carbon atoms,

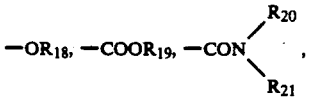

or a phenyl group.

13. The method as claimed in claim 1, wherein the color developer has a pH value in the range of pH 9 to pH 12.

14. The method as claimed in claim 1, wherein the processing time with the color developer is 10 to 120 sec.

15. The method as claimed in claim 1, wherein the processing time with the color developer is 20 to 60 sec. at a processing temperature of 33° to 45° C.

16. The method as claimed in claim 1, wherein the processing time with the color developer is 10 to 40 sec. at a processing temperature of 33° to 60° C.

17. The method as claimed in claim 1, wherein the processing time with the color developer is 20 to 35 sec. at a processing temperature of 36° to 50° C.

18. The method as claimed in claim 1, wherein the amount of the replenisher of the color developer during continuous processing is 20 to 220 ml per 1 $m^2$ of the photographic material.

19. A method for processing a silver halide color photographic material which comprises processing an image-wise exposed photographic material being provided with at least one silver halide emulsion layer emulsion of which substantially comprises silver chloride, with a color developer containing an aromatic primary amine color developing agent and at least one of compounds represented by the following formula (I):

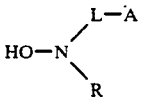

Formula (I)

wherein L represents an alkylene group, A represents a carboxyl group, a sulfo group, a phosphono group, a phosphinic acid residue, a hydroxyl group, an amino group, an ammonio group, a carbamoyl group, a sulfamoyl group, or an alkylsulfonyl group, and R represents a hydrogen atom or an alkyl group, for 10 to 40 seconds, by using an automatic processor in which the opened surface ratio of the color developer in the tank is 0.015 $cm^{-1}$ or below.

* * * * *